US012343844B2

(12) United States Patent
Valentini

(10) Patent No.: US 12,343,844 B2
(45) Date of Patent: Jul. 1, 2025

(54) PROTECTIVE SHROUD FOR A HAND-GUIDED POWER TOOL AND HAND-GUIDED POWER TOOL WITH SUCH A PROTECTIVE SHROUD

(71) Applicant: Guido Valentini, Milan (IT)

(72) Inventor: Guido Valentini, Milan (IT)

(73) Assignee: Guido Valentini, Milan (IT)

( * ) Notice: Subject to any disclaimer, the term of this patent is extended or adjusted under 35 U.S.C. 154(b) by 608 days.

(21) Appl. No.: 17/152,937

(22) Filed: Jan. 20, 2021

(65) Prior Publication Data

US 2021/0229239 A1 Jul. 29, 2021

(30) Foreign Application Priority Data

Jan. 23, 2020 (EP) ..... 20153380

(51) Int. Cl.
*B24B 55/05* (2006.01)
*B24B 23/02* (2006.01)

(52) U.S. Cl.
CPC ..... *B24B 55/052* (2013.01); *B24B 23/02* (2013.01)

(58) Field of Classification Search
CPC ..... B24B 23/005; B24B 23/02; B24B 23/04; B24B 55/04; B24B 55/05; B24B 55/052; B24B 55/055; B24B 55/102; B24B 23/022; B24B 23/028; B24B 23/03; B24B 41/002; B24B 41/04; B24B 41/044; B24B 45/003; B24B 45/006; B25F 5/02
USPC ..... 451/451, 452, 454, 455, 457, 460
See application file for complete search history.

(56) References Cited

U.S. PATENT DOCUMENTS 3,862,521 A * 1/1975 Isaksson ..... B24B 55/102 451/358
8,133,094 B2 * 3/2012 Loveless ..... B24B 55/10 451/457
8,177,606 B2 * 5/2012 Loveless ..... B24B 55/052 451/454
9,278,427 B2 * 3/2016 Numata ..... B24B 55/05
9,731,412 B2 * 8/2017 Valentini ..... B24B 23/005
(Continued)

FOREIGN PATENT DOCUMENTS

CN 105538241 A 5/2016
CN 206373740 U 8/2017
CN 107214595 A * 9/2017
(Continued)

OTHER PUBLICATIONS

CN-107214595-A (XU) published on Sep. 29, 2017 Translation retrieved from Google Patents: https://patents.google.com/patent/CN107214595A/en?oq=XU+CN107214595A.*
(Continued)

*Primary Examiner* — Eric J Rosen
*Assistant Examiner* — Christopher Soto
(74) *Attorney, Agent, or Firm* — William J. Barber; WARE FRESSOLA MAGUIRE & BARBER LLP

(57) ABSTRACT

The invention refers to a protective shroud (40) for a hand-guided power tool (1), in particular a polisher or sander, the protective shroud (40) being adapted to be attached to a housing (2) of the power tool (1) and to cover at least part of a working element (11) of the power tool (1). It is suggested that the protective shroud (40) is secured to the housing (2) in at least one direction by means of magnetic force (47, 59).

21 Claims, 9 Drawing Sheets

(56) References Cited

U.S. PATENT DOCUMENTS

| | | | | |
|---|---|---|---|---|
| 2005/0153640 | A1* | 7/2005 | Stein | B24B 45/006 451/494 |
| 2016/0121475 | A1 | 5/2016 | Valentini | |

FOREIGN PATENT DOCUMENTS

| | | | |
|---|---|---|---|
| DE | 10 2015 217093 | A1 | 3/2017 |
| DE | 20 2014 011331 | U1 | 6/2019 |
| DE | 10 2018 206869 | A1 | 11/2019 |
| EP | 2 269 771 | A1 | 1/2011 |

OTHER PUBLICATIONS

English Abstract of CN105538241A.
English Abstract of CN206373740U.
English language translation of DE202014011331U1.
English Abstract of CN 107214595A.
English Abstract of DE102018206869A1.
English Abstract of 102015217093A1.

* cited by examiner

PROTECTIVE SHROUD FOR A HAND-GUIDED POWER TOOL AND HAND-GUIDED POWER TOOL WITH SUCH A PROTECTIVE SHROUD

BACKGROUND OF THE INVENTION

1. Field of Invention

The present invention refers to a protective shroud for a hand-guided power tool, in particular a polisher or sander. The protective shroud is adapted to be attached to a housing of the power tool and to cover at least part of a working element of the power tool.

Further, the invention refers to a hand-guided power tool, in particular a polisher or sander, comprising a housing containing a motor, a working element driven by the motor and rotating about a rotational axis during operation of the motor and protruding at least partially from the housing, and a protective shroud being attached to the housing and covering at least part of the working element.

2. Brief Description of Related Art

Power tools and protective shrouds of the above-identified kind are well-known in the prior art. For example, an angular polisher or sander comprises a housing, preferably made of plastic and containing a motor for driving a working element, which may be in the form of a backing pad. A polishing or sanding member may be releasably attached to a bottom surface of the working element, e.g. by means of a hook-and-loop fastener (Velcro®). The working element may have a circular, a rectangular, a triangular or a delta-shaped form. They may perform a purely rotational, an orbital or eccentric, a random-orbital or a roto-orbital (gear-driven) working movement. Depending on the type of working movement the working element exerts, different types of functional units may be interposed between a tool shaft driven by the motor and the working element. The functional units may comprise, e.g. a simple extension element, an eccentric element or a gear mechanism, in particular an epicyclic or planetary gear mechanism. The extension is attached to the tool shaft and the working element in a torque proof manner, in order to realize a purely rotational working movement of the working element corresponding to the rotational movement of the tool shaft. An eccentric element is attached to the tool shaft in a torque proof manner. The working element is supported in the eccentric element in a freely rotatable manner about its rotational axis. The rotational axes of the tool shaft and the working element extend essentially parallel and in a distance (the orbit or eccentric) to each other. If the working element is prevented from freely rotating about its rotational axis, an orbital or eccentric working movement of the working element may be realized. The eccentric element serves for realizing a random-orbital working movement. A gear mechanism serves for realizing a roto-orbital or gear-driven working movement.

The working element is at least partially covered by a protective shroud, which is usually mechanically fixed to the housing of the power tool. The protective shroud may serve a variety of purposes. First of all, it may serve to protect a user of the power tool from moving parts of the power tool protruding from the housing. These moving parts may comprise a distal end of the tool shaft, at least part of the functional unit and/or a part of the working element facing towards the housing, e.g. a top surface of a backing pad or a part thereof. Further, the protective shroud may serve as a dust collecting member for collecting at least part of the dust and small particles created on a working surface during intended use of the power tool. To this end, an inside cavity of the protective shroud is preferably attached to an internal dust extraction device of the power tool and/or an external dust extraction device, e.g. a vacuum cleaner. Furthermore, the protective shroud may serve as a braking member, for slowing down, impeding or even completely preventing a rotation of the working element about its rotational axis, when supported by an eccentric element in a freely rotatable manner. In this way, the random-orbital movement of the working element may be turned into an orbital or eccentric working movement.

The protective shroud is usually made of plastic material, preferably a soft plastic or synthetic rubber material or a rigid hard plastic material. It is usually attached to the housing of the power tool by means of a mechanical connection, e.g. by means of screws, a snap-on connection, a clamping connection or the like. Attachment and detachment of the protective shroud, in particular replacing the protective shroud, is complicated and time-consuming. In particular, separate tools (e.g. a screwdriver, a wrench or the like) are required for attachment and detachment of the protective shroud.

SUMMARY OF THE INVENTION

The object of the present invention is to provide for a protective shroud which can be attached to the housing of a power tool and detached from the housing fast and easy and which nonetheless may be attached to the housing in a safe and reliable manner.

This object is solved by a protective shroud comprising the features of claim 1. In particular, starting from a protective shroud of the above-identified kind, it is suggested that the protective shroud is secured to the housing in at least one direction by means of magnetic force.

This allows for a fast and easy attachment of the protective shroud to the housing of the power tool and detachment of the protective shroud from the housing, whenever desired. When during attachment bringing the protective shroud near a respective part of the housing, to which the protective shroud is to be attached, a magnetic force may act between the protective shroud and the housing and automatically secures the protective shroud to the housing. Similarly, the magnetic force may also act between two separate parts of the protective shroud. In order to detach the protective shroud from the housing simply the magnetic force has to be overcome. This can be easily effected by gripping the protective shroud and pulling it away from the housing or pulling two separate parts of the protective shroud apart. The attachment and detachment of the protective shroud may be effected without any separate tools.

The shroud may extend a full 360°-circumference around a rotational axis of the tool shaft or only part of the circumference, e.g. 270° or 180°. The shroud covers at least part of the working element. Preferably, the shroud also covers or surrounds at least part of a functional unit arranged between the tool shaft and the working element. The functional unit may comprise an eccentric element (for realizing a random-orbital working movement of the working element, if the working element is freely rotatable in respect to the eccentric element, or for realizing a purely orbital working movement, if free rotation of the working element in respect to the eccentric element is prevented) or a cylindrical extension element (for realizing a purely rotational working movement) or a gear arrangement (for realizing a gear-driven working movement).

The shroud may be provided with one or more magnetic elements facing the working element and adapted to interact with respective magnetic elements provided in a top surface of the working element (e.g. a backing pad) facing the shroud. The magnetic elements may comprise permanent magnets and/or ferromagnetic elements. Interaction of the magnetic elements creates a magnetic attraction force between the magnetic elements of the shroud and the magnetic elements of the working element, thereby slowing down or completely inhibiting a rotational movement of the working element about its rotational axis in respect to an eccentric element, in which the working element is supported in a manner freely rotatable about its rotational axis. By slowing down or preventing a free rotation of the working element about its rotational axis, a random-orbital working movement may be converted into a purely orbital working movement. In a power tool comprising a working element (e.g. a backing pad) with magnetic elements in its top surface, the working movement of the working element can be changed from a random-orbital movement to an orbital movement simply by replacing a shroud without magnetic elements (for the random-orbital movement) with a shroud equipped with magnetic elements (for the orbital movement).

Furthermore, the shroud may be provided with one or more light sources, preferably semiconductor light sources, in particular LEDs, which emit light. LEDs have the advantage that they have a low energy consumption and emit relatively bright light. The light sources are advantageously arranged such that the light is emitted to the front of the power tool, thereby allowing the user an easy and precise inspection of the surface to be worked or currently under work. The main direction of light emission is directed obliquely in respect to the surface extension of the working surface. It is suggested that the shroud is also provided with an electric energy source, e.g. a battery, for supplying the light source with electric energy. The electric energy source may also comprise some kind of generator or dynamo for inductively creating an electric current, due to the working movement of the working element in respect to the protective shroud. To this end, one or more permanent magnets of the working element may be used to induce electric current in one or more electric conductors of the shroud. The electric current induced in the conductor(s) may be used for charging the battery and/or operating the light sources. Alternatively, the battery may be replaced by a new (fully charged) battery. It would even be possible to replace the entire shroud with a new shroud with a light source and a fully charged battery. The light sources may be part of an adapter element or of the shroud itself. It would even be possible that the light sources may be operated by means of electric current from the power tool without the necessity of a separate battery and/or a dynamo or generator and/or an induction cable in the shroud.

The protective shroud according to the invention is particularly advantageous if the power tool is provided with the ability to interchange different types of functional units in order to achieve different working movements of the working element with the same power tool. For example, by exchanging a mere extension element with an eccentric element, the working movement can be changed from purely rotational to random-orbital. Furthermore, by exchanging an eccentric element having a first orbit or eccentric (e.g. 2 or 3 mm) with another eccentric element having a second orbit or eccentric (e.g. 12 mm), the size of the orbit or eccentric of a random-orbital working movement can be changed. Such a power tool is known, for example, from EP 3 012 068 A1, which is incorporated herein in its entirety by reference.

Furthermore, if the entire functional unit or part of it could even be omitted in a power tool, e.g. by directly attaching the working element to the tool shaft, replacement of the protective shroud or of part of it may become necessary. In particular, due to the missing functional unit the distance between the housing and the working element (e.g. the backing pad) may decrease requiring a flatter or lower protective shroud. Such a power tool is known, for example, from co-pending EP-application "Functional Unit for a Hand-Guided Power Tool and Power Tool with such a Functional Unit" having the same inventor and filed the same day as the present patent application. That application is also incorporated herein in its entirety by reference.

According to the invention, it is differentiated between attachment of the protective shroud to the housing of the power tool and securing of the shroud to the housing. Attachment of the shroud comprises the mere positioning of the shroud at a desired attachment position in respect to the housing. The shroud merely attached (but not secured) to the housing could be easily detached from the housing. In order to avoid an unintentional detachment of the shroud form the housing, the shroud is secured to the housing. While attachment of the shroud may be effected in any desired way, in particular mechanically, according to the invention securing of the shroud is effected by means of magnetic force.

Attachment of the protective shroud to the housing of the power tool may be effected, for example, by inserting part of the housing, to which the shroud is to be attached, into a respective receptacle of the shroud defined in its inside. Insertion of the housing into the receptacle may be effected in an axial direction running essentially parallel to the rotational axis of the tool shaft. The inserted part of the housing is secured inside the receptacle of the shroud by means of magnetic force, preferably acting between the shroud and the housing. Alternatively, the shroud may be designed as to encompass in a radial direction that part of the housing, to which the shroud is to be attached, the radial direction running essentially perpendicular in respect to the rotational axis of the tool shaft. The encompassed shroud is secured to the housing by means of magnetic force, preferably acting between separate parts of the shroud thereby clamping it around and in respect to the housing.

Hence, the magnetic force for securing the shroud to the housing may act in an axial direction, i.e. parallel to a rotational axis of the tool shaft, in particular between the shroud and the housing, or in a circumferential direction, i.e. about the rotational axis of the tool shaft, in particular between separate parts of the shroud. Preferably, the protective shroud has an essentially tube-like form with a longitudinal axis extending there through and the magnetic force acts in an axial direction parallel to the longitudinal axis. Alternatively, the protective shroud has an essentially tube-like form with a longitudinal axis extending there through and the magnetic force acts in a circumferential direction in respect to the longitudinal axis.

According to a preferred embodiment of the invention, it is suggested that the protective shroud is adapted to be directly attached to the housing of the power tool. In that case the magnetic force for securing the shroud to the housing acts directly between the shroud and the housing. To this end, appropriate magnetic elements are provided in the shroud and the housing. The magnetic elements could comprise permanent magnets and/or ferromagnetic elements. If the housing or the shroud is made of a ferromagnetic material, the housing or the shroud itself could be used as a ferromagnetic element.

Alternatively, it is suggested that the protective shroud is adapted to be indirectly attached to the housing of the power tool by means of an adapter element fixed to the housing. In that case the magnetic force for securing the shroud to the housing acts between the shroud and the adapter element, i.e. indirectly between the shroud and the housing. To this end, appropriate magnetic elements are provided in the shroud and the adapter element. The magnetic elements could comprise permanent magnets and/or ferromagnetic elements. If the adapter element or the shroud is made of a ferromagnetic material, the adapter element or the shroud itself could be used as a ferromagnetic element. The adapter element may be fixed to the housing in any possible manner, e.g. comprising mechanical fixation such as by means of a clamping connection, a snap-on or clip connection, a bayonet connection, a gluing or welding connection. In the following, when mentioning attachment of the shroud to the housing, this always comprises a direct attachment of the shroud to the housing as well as an indirect attachment by means of an adapter element fixed to the housing.

The protective shroud is preferably made of a plastic material, preferably a soft plastic or synthetic rubber material. Of course, the protective shroud could also be made of a rigid or hard plastic material, if desired. The material of the shroud is preferably resilient and elastic enough so that it can be bent open for attachment to the housing of the power tool or a respective adapter element fixed to the housing. Alternatively, the shroud could also comprise one or more hinge elements, a snap-on elements, or the like for bending open the shroud and for attachment to the housing of the power tool or an adapter element fixed to the housing. Magnetic elements for achieving the magnetic force for securing the shroud to the housing of the power tool or to an adapter element fixed to the housing, may be inserted into respective receptacles provided in the shroud, and fixed therein, e.g. by means of friction, gluing or welding or mechanical fixation (e.g. screws, rivets, etc.). The magnetic elements could also be fixed in the receptacles by closing the receptacles with a respective lid. Alternatively, the magnetic elements could also be integrated into the shroud during the manufacturing process of the shroud, e.g. by means of co-moulding.

Respective magnetic elements for achieving the magnetic force for directly or indirectly securing the shroud to the housing or the adapter element, may be inserted into respective receptacles provided in the housing or the adapter element, and fixed therein, e.g. by means of friction, gluing or welding or mechanical fixation (e.g. screws, rivets, etc.). The magnetic elements could also be fixed in the receptacles of the housing or the adapter element by closing the receptacles with a respective lid. Alternatively, the magnetic elements could also be integrated into the housing or the adapter element during the manufacturing process of the adapter element, e.g. by means of co-moulding.

According to a preferred embodiment of the invention, the protective shroud has an essentially tube-like form with a cavity defined in its inside adapted for receiving at least part of a functional unit and/or of a top surface of the working element when the protective shroud is attached to the housing of the power tool. A diameter of an external circumference of the tube-like protective shroud may increase towards an end of the shroud opposite to the end with which it is attached to the housing resulting in a larger diameter towards the working element. This permits arrangement of a cavity inside the protective shroud of particularly large dimensions for receiving, e.g. a functional unit with an eccentric element having a particularly large orbit.

According to a further embodiment of the invention, the protective shroud has an essentially tube-like form with a receptacle defined in its inside adapted for receiving at least part of the housing of the power tool or of an adapter element fixed to the housing. The receptacle is arranged at an end of the shroud with which it is attached to the housing. Preferably, the receptacle opens into the cavity for receiving or surrounding at least part of a functional unit and/or of a top surface of the working element when the protective shroud is attached to the housing of the power tool. The opening serves for allowing the tool shaft of the power tool and/or the functional unit to pass through the shroud. Changing the functional unit thereby provoking a different orbit of the working element (e.g. a backing pad) could make replacement or omission of the shroud or part of it necessary.

An opening of the receptacle is preferably arranged at an end of the protective shroud opposite to an end of the protective shroud where an opening of the cavity is arranged. The opening of the receptacle faces towards the housing and serves for receiving the housing or the adapter element. The opening of the cavity faces towards the working element and serves for receiving or surrounding the functional unit or part of it and/or part of the top surface of the working element (e.g. the backing pad).

The receptacle may be separated from the cavity by means of at least one abutment member, e.g. an abutment collar, extending radially inwards towards the longitudinal axis of the protective shroud. The abutment member serves for limiting an insertion movement of the housing or the adapter element into the receptacle and in order to provide for an attachment of the shroud to the housing or the adapter element in a predefined plane. Preferably, the plane extends essentially perpendicular in respect to the longitudinal axis of the shroud and the rotational axis of the tool shaft.

Preferably, the receptacle is adapted to receive at least part of the housing of the power tool or of the adapter element fixed to the housing in an axial direction parallel to a longitudinal axis extending through the protective shroud. Hence, according to this embodiment, the part of the housing or of the adapter element is inserted into the receptacle in the axial direction, i.e. along the longitudinal axis of the shroud. In this case, the magnetic force preferably acts in the axial direction between the shroud and the housing or the adapter element, respectively.

Alternatively, the receptacle is adapted to receive at least part of the housing of the power tool or of the adapter element fixed to the housing in a radial direction perpendicular to a longitudinal axis extending through the protective shroud. Hence, according to this embodiment, a bottom end of the front casing of the housing or of an adapter element fixed to the housing is inserted into the receptacle in the radial direction, i.e. obliquely to the longitudinal axis of the shroud. In this case, the magnetic force preferably acts in a circumferential direction between separate parts of the shroud.

It is suggested that the protective shroud has at least one lateral slit extending in an essentially axial direction parallel to a longitudinal axis extending through the protective shroud, the slit adapted for laterally opening the protective shroud and laterally encompassing at least part of the housing of the power tool or of the adapter element fixed to the housing in a radial direction perpendicular to the longitudinal axis extending through the protective shroud. The shroud may be bent open along the slit in order to provide for a lateral insertion opening through which that part of the housing or the adapter element, to which the shroud is attached, may be inserted in the radial direction. After insertion of the part of the housing or the adapter element, the shroud is brought into its original form again by approximating the two side walls of the shroud limiting the slit, thereby encompassing the respective part of the housing or of the adapter element. The slit is kept in a closed state by means of the magnetic force. Preferably, the magnetic force acts in a tangential direction in respect to the longitudinal axis of the shroud.

Alternatively, it is suggested that the protective shroud is made up of at least two separate shell-like elements, in particular exactly two half-shell-like elements, separated from each other by a vertical plane comprising a longitudinal axis extending through the protective shroud, adapted for separation of the shell-like elements and laterally encompassing at least part of the housing of the power tool or of the adapter element fixed to the housing in a radial direction perpendicular to the longitudinal axis extending through the protective shroud. The shroud may be separated into its two half-shell-like elements. The elements are laterally applied to that part of the housing or the adapter element, to which the shroud is attached, thereby covering the part. The side walls of the shroud limiting the vertical plane of separation are approximated, thereby encompassing the respective part of the housing or of the adapter element. The two half-shell-like elements are kept attached together by means of the magnetic force. Preferably, the magnetic force acts in a tangential direction in respect to the longitudinal axis of the shroud.

According to yet another preferred embodiment of the invention, it is suggested that the protective shroud comprises at least one protrusion or recess adapted for interacting with a corresponding recess or protrusion provided on the housing of the power tool or on an adapter element fixed to the housing, in order to prevent the protective shroud attached to the housing or to the adapter element from unintentionally slipping off the housing or the adapter element. For example, the housing or the adapter element may be provided with a circumferential radially extending collar member, which is inserted into a respective groove of the shroud, when the shroud is attached to the housing or the adapter element. The collar and/or the groove preferably extend in a plane obliquely or perpendicular to the longitudinal axis of the shroud.

According to yet another embodiment, the protective shroud has at least one protrusion or recess adapted for interacting with a corresponding recess or protrusion provided on the housing of the power tool or on an adapter element fixed to the housing in order to allow attachment of the protective shroud to the housing or to the adapter element in only one or more discrete rotational positions about a longitudinal axis extending through the protective shroud. For example, the housing or the adapter element may be provided with a protrusion which is inserted into a respective notch of the shroud, when the shroud is attached to the housing or the adapter element. The protrusion and/or the notch preferably extend in an axial direction parallel to the longitudinal axis of the shroud. This permits an attachment or insertion movement of the housing or the adapter element into the recess of the shroud in a direction essentially parallel to the longitudinal axis, but only in one or more certain discrete rotational positions, where the or all protrusions are aligned with one or more respective grooves. Alignment can be achieved by rotating the protective shroud in respect to the housing or the adapter element about the longitudinal axis of the shroud.

Further features and advantages of the present invention will be described in detail hereinafter with reference to the accompanying drawings. It is emphasized that the shown embodiments are purely exemplary and are not intended to limit the invention in any way. In particular, the present invention also comprises embodiments with only one or any possible combination of the features shown in the drawings and/or described hereinafter, even if such embodiments are not explicitly shown in the drawings and/or mentioned in the description. The drawings show:

BRIEF DESCRIPTION OF THE DRAWING

The drawing includes FIGS. 1-16, as follows.

DETAILED DESCRIPTION OF THE BEST MODE OF THE INVENTION

Figure 1:
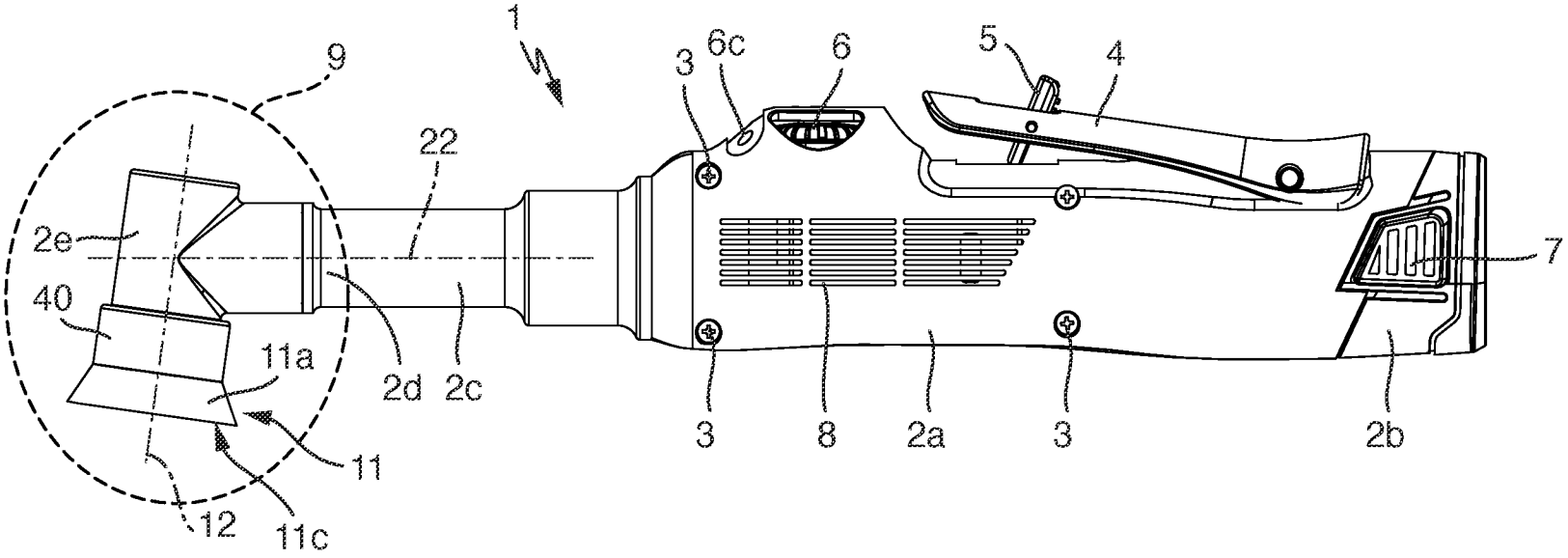
FIG. 1 an example of a hand-guided power tool according to the present invention in a side view.
Figure 2:
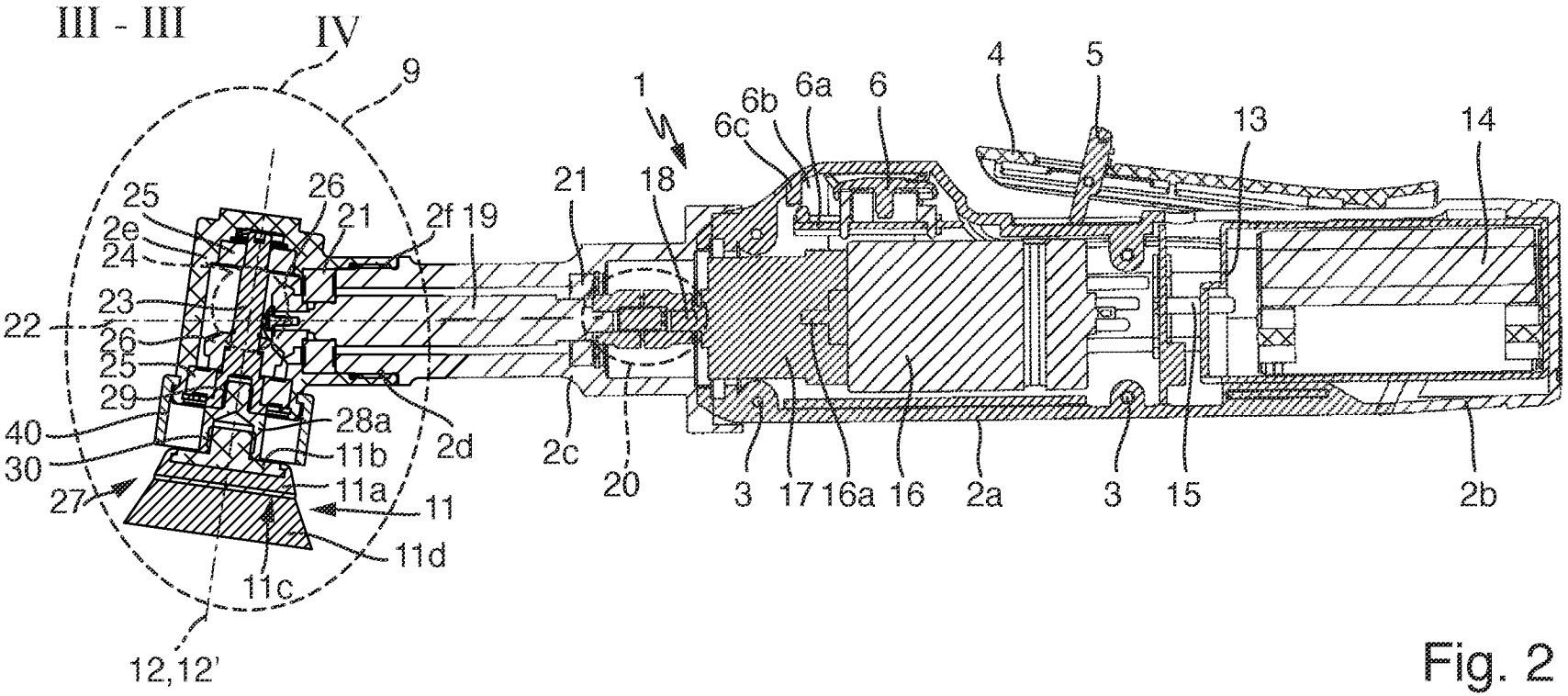
FIG. 2 the power tool of FIG. 1 in a longitudinal sectional view.

FIGS. 1 and 2 show a side view of a hand held and/or hand guided power tool 1 according to the present invention. Depending on the type of functional unit 27 attached thereto, the power tool 1 may be embodied as a polishing machine or polisher, a sanding machine or sander or any other type of power tool 1 for working tight and cramped spaces on exterior and/or interior surfaces of a motor vehicle, a boat or ship or an airplane. In particular, the power tool 1 may be used for sanding small areas of a vehicle body, or for polishing or cleaning a motor vehicle behind door handles, around exterior mirrors, along window frames, around a sunroof, wheel rims, and at the vehicle front and rear, in particular in and around air ducts, a radiator grill and a front or rear spoiler, as well as seat cushions, door panels, dashboard, outlet nozzles of a heating and climate system. Such a power tool 1 is described, for example, in EP 3 012 068 A1. Until the power tool according to EP 3 012 068 A1 in the form of the RUPES Bigfoot Nano iBrid was available on the market, such areas of a motor vehicle, boat, ship or airplane were usually cleaned, sanded or polished by hand.

The power tool 1 includes a housing 2 which may be made up of essentially two main parts, a rear part 2*a* and a front part 2*c*. In more detail, the housing 2 comprises the rear part 2*a* including a distal rear end part 2*b*, and the front part 2*c* including a front casing 2*e*. The rear part 2*a* is preferably made of a rigid plastics material. Of course, the rear part 2*a* of the housing 2 could also be made of a different rigid material, for example metal or carbon fibre. Further, the rear part 2*a* of the housing 2 could comprise regions provided with resilient material like a soft plastic material or rubber in order to ensure safe and comfortable gripping, holding and guiding of the power tool 1 by a user. The rear part 2*a* of the housing is preferably hollow and is adapted to receive various components of the power tool 1 as will be described in further detail hereinafter with reference to FIG. 2. The rear part 2 may be divided into two half shells which are divided from each other along an essentially vertical plane. The two half shells are attached to each other, for example by means of screws 3. Alternatively, the two half shells could also be attached to each other by means of rivets, one or more snap-on couplings, glue or the like.

The front part 2*c* of the housing 2 can be fixed to the rear part 2*a* of the housing 2 by screws, a threaded connection or a similar attachment mechanism commonly known in the art. Of course, the front part 2*c* and the rear part 2*a* of the housing 2 could be embodied as a single common housing unit, too. Preferably, the front part 2*c* is made of metal, in particular aluminium or steel, and has an essentially tubular form. The front part 2*c* receives a first tool shaft 19 in a manner so as to allow its rotation about a rotational axis 22. To this end, one or more bearings 21, e.g. in the form of a ball race, may be provided inside the front part 2*c* which rotatably support the first tool shaft 19. The front casing 2*e* may also be made of metal, in particular aluminium or steel, and have an essentially tubular form. The front casing 2*e* receives a second tool shaft 23 in a manner so as to allow its rotation about a rotational axis 12. To this end, one or more bearings 25, e.g. in the form of a ball race, may be provided inside the front casing 2*e*, which rotatably support the second tool shaft 23.

A tool head 9 is located at a front distal end 2*d* of the front part 2*c* of the housing 2. The tool head 9 is preferably fixed to the distal end 2*d* by screws, a threaded connection 2*f* or a similar attachment mechanism. The tool head 9 comprises the front casing 2*e* and a working element 11 adapted for working a surface of a workpiece during intended use of the power tool 1.

The working element 11 may comprise a backing pad 11*a* to which a sanding member 11*e* (see FIGS. 7 to 9 and 11) or a polishing member 11*d* is attached. The backing pad 11*a* may comprise a supporting structure 11*b*, for example made of metal or a rigid plastics material. The sanding or polishing member 11*e*, 11*d* is preferably attached to a bottom surface 11*c* of the backing pad 11*a* in a releasable manner, e.g. by means of a hook-and-loop fastener or an adhesive. The backing pads 11*a* may have a rather small diameter of, for example, 30 mm, 50 mm or 75 mm. The sanding member 11*e* may comprise a sanding paper or a sanding fabric provided with abrasive particles on its bottom surface. The form and size of the sanding member 11*e* preferably corresponds to the form and size of the bottom surface 11*c* of the backing pad 11*a*. The polishing member 11*d* may comprise a polishing pad made of foam with different rigidities and pore sizes, or with wool of different hardness or microfibers of different fibre diameters. The form and size of the top surface of the polishing member 11*d* preferably corresponds to the form and size of the bottom surface 11*c* of the backing pad 11*a*. Of course, the working element 11 could also comprise an integrated sanding or polishing pad where the sanding or polishing member is fixedly attached to the backing pad 11*a* and forms an integral part thereof. Further, the working element 1 could comprise, for example, rotary brushes with bristles made of natural or synthetic materials of different hardness.

The rear part 2*a* of the housing 2 includes an actuation lever 4 co-operating with a switch for turning on and off the power tool 1. The switch is preferably located inside the rear part 2*a* of the housing 2. The actuation lever 4 may be provided on the top side (see FIGS. 1 and 2) or on the bottom side of the housing 2 (not shown). The actuation lever 4 may have a blocking mechanism 5 for avoiding unintentional activation of the tool 1. Preferably, when pressing the lever 4 and turning the tool 1 on, a spring force must be overcome. The spring force forces the lever 4 back into its original position if the user of the tool 1 lets go. Furthermore, the rear part 2*a* of the housing may be provided with a turn wheel 6 for speed regulation of a tool's motor 16. The turn wheel 6 may be provided on the top side (see FIGS. 1 and 2), on the bottom side (not shown) or an any lateral side of the housing 2 (not shown). The rear part 2*a* of the housing 2 may be provided with a plurality of slots 8 for enabling an air exchange between the inside and the environment outside of the housing 2 and for cooling the electronic components located inside the housing 2.

The distal rear end 2*b* of the rear part 2*a* of the housing 2 can be removed in order to withdraw at least one battery 14 (see FIG. 2) from the inside of the rear part 2*a* of the housing 2. One or more batteries 14 may be combined to form a battery pack 13. A receptacle for receiving the battery pack 13 is formed in the inside of the rear part 2*a* of the housing 2. The battery pack 13 may be attached to the distal rear end 2*b* of the housing 2, e.g. by means of a frictional connection, a snap-on connection, glue or screws, or it may form an integral part of the distal rear end 2*b*. The distal end 2*b* of the housing 2 serves as a cover of the receptacle for the battery pack 13 and may be secured to the rear part 2*a* by a snap-action connection comprising two opposite lateral knobs 7 for releasing the snap-action connection. For removing the distal rear end 2*b* from the rear part 2*a* of the housing 2, the lateral knobs 7 are pressed, thereby releasing the snap-action connection and allowing separation of the distal end 2*b* of the housing 2 from the rear part 2*a* and withdrawal of the battery pack 13 from the housing 2.

The battery pack 13 provides the power tool 1 and its electronic components, respectively, with electric energy necessary for their operation. Upon insertion of the battery pack 13 into the rear part 2*a* of the housing 2 the one or more batteries 14 are automatically connected to electric connectors 15, fixedly located inside the housing 2. Electric energy stored in the battery 14 is provided to the other electrical components of the polisher 1 via the connectors 15. Of course, the power tool 1 could also be operated with electric energy from a mains power supply. In that case the battery pack 13 would not be necessary and the receptacle for the battery pack 13 could be used for accommodating a transformer and other electric circuitry for transforming the mains voltage from 100V to 250V and from 50 Hz to 60 Hz, into an operating voltage (e.g. 12V, 18V, or 24V) for the electronic components of the power tool 1.

Furthermore, located inside the rear part 2*a* of the housing 2 is an electric motor 16, preferably a brushless (BL) motor, in particular a BL direct current (BLDC) motor, with a motor shaft 16*a*. Of course, other types of electric motors 16, e.g. an AC-motor, could also be used. In the shown embodiment of FIG. 2 the motor shaft 16*a* actuates a first gear mechanism 17 which can define a certain ratio between the rotational speed of the motor shaft 16*a* and the rotational speed of the tool shaft 19 and/or 23, which eventually drives the working element 11. Depending on the design of the gear mechanism 17, the ration can be 1, larger than 1 or smaller than 1. Usually, the ratio will be larger than 1 causing the tool shaft 19 and/or 23 to rotate slower than the motor shaft 16*a*, thereby increasing the torque which is applied to the tool shaft 19 and/or 23. Preferably, the first gear mechanism 17 is an epicyclical gear. The gearbox output shaft is designated with reference sign 18. The output shaft 18 is connected to a first tool shaft 19 by means of a coupling assembly 20.

The power tool 1 can include a second gear mechanism 24 in order to translate the rotational movement of the motor shaft 16*a* and of the first tool shaft 19, respectively, about a first rotational axis 22 into a rotational movement of the second tool shaft 23 about a second rotational axis 12, whereas the two axes 12, 22 intersect at a certain angle larger than 0° and smaller than 180°, in particular around 90°. Preferably, the angle of the two rotational axes 12, 22 is approximately 97°-98°. The second tool shaft 23 eventually drives the working element 11. It is suggested that the second gear mechanism 24 includes a bevel gear with two bevel gear wheels 26. The gear ratio of the second gear mechanism 24 can be 1, larger than 1 or smaller than 1. The second gear mechanism 24 is preferably located in the tool head 9 of the power tool 1, in particular in the front casing 2*e* of the housing 2.

In contrast to the embodiment of FIG. 2 the separate first and second gear mechanisms 17, 24 could also be designed as a single gear mechanism, e.g. located in the tool head 9 of the power tool 1, in particular in the front casing 2*e* of the housing 2. In that case the motor shaft 16*a* would be directly coupled to the first tool shaft 19 by means of the coupling assembly 20. Alternatively, the first tool shaft 19 could form an integral part of the motor shaft 16*a*. The desired gear ratio between the motor shaft 16*a* and the tool shaft 23 could be realized by the second gear mechanism 24. Hence, the second gear mechanism 24 would not only provide for a translation of the rotation of the first tool shaft 19 to a rotation of the second tool shaft 23 by approximately 90°, but would also provide for a certain gear ratio between the rotational speed of the first tool shaft 19 (corresponding to the rotational speed of the motor shaft 16*a*) and the second tool shaft 23. Preferably, the second gear mechanism 24 would provide for a gear ration larger than 1, thereby reducing the rotational speed and increasing the torque of the second tool shaft 23 in respect to the motor shaft 16*a* or the first tool shaft 19, respectively. In that case, the function of the two separate gear mechanisms 17, 24 of FIG. 2 would be integrated in a single gear mechanism, like for instance bevel gear 24. Alternatively, the power tool 1 according to the present invention may also include only one of the two gear mechanisms 17, 24 or no gear mechanism at all.

Furthermore, at least one printed circuit board (PCB) comprising electric and electronic components which together form at least part of a control unit 6*a* is located inside the housing 2, in particular inside the rear part 2*a* of the housing 2. Preferably, the control unit 6*a* includes a microcontroller and/or a microprocessor for processing a computer program which is programmed to perform the desired motor control function, when it is executed on the microprocessor. The power tool 1 may comprise one or more LEDs 6*b*, which indicate the current load status of the batteries 14. In this embodiment the one or more LEDs 6*b* are attached to the PCB of the control unit 6*a*. Light emitted by the LEDs 6*b* may pass through a transparent window 6*c* provided in the rear part 2*a* of the housing 2. For example, the one or more LEDs 6*b* may emit green light, when the load status is between 100% and 75%, yellow light, when the load status is between below 75% and 50%, red light, when the load status is below 50%, and flashing red light, when the load status is below 25%.

The power tool 1 comprises a functional unit 27, which is releasably attached to the second tool shaft 23. The functional unit 27 comprises a base element 28, a first attachment member 29 for releasable attachment of the base element 28 to the motor driven tool shaft 23 of the power tool 1, and a second attachment member 30 for attachment of the working element 11 to the base element 28.

Figure 12:
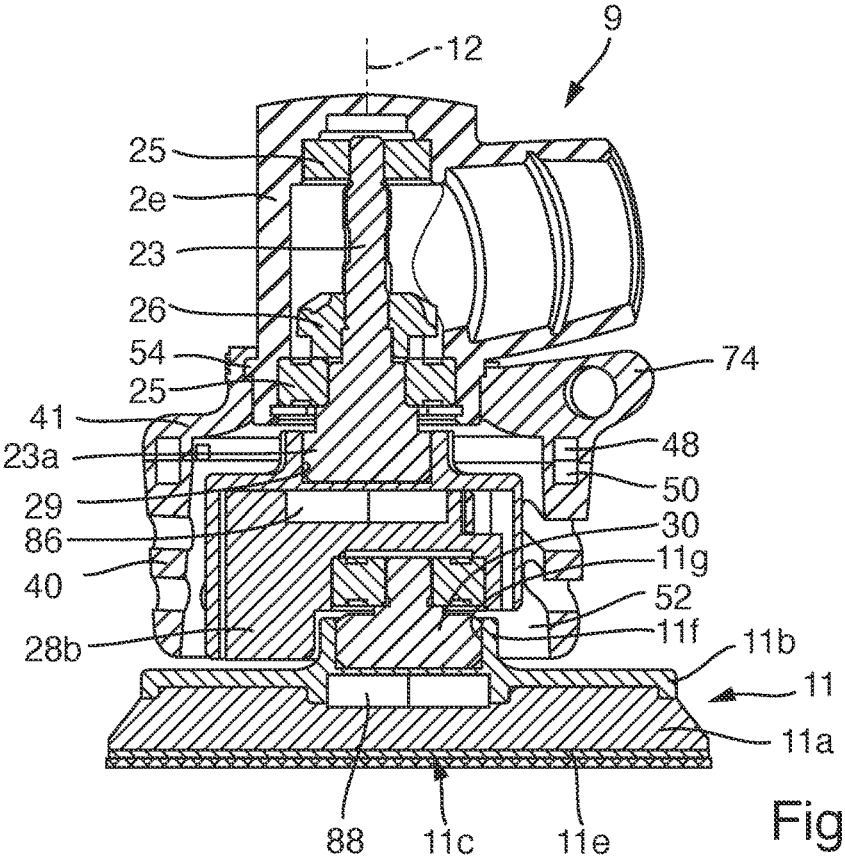
FIG. 12 an example of a front tool head of a hand-guided power tool according to the present invention in a sectional view.
Figure 13:
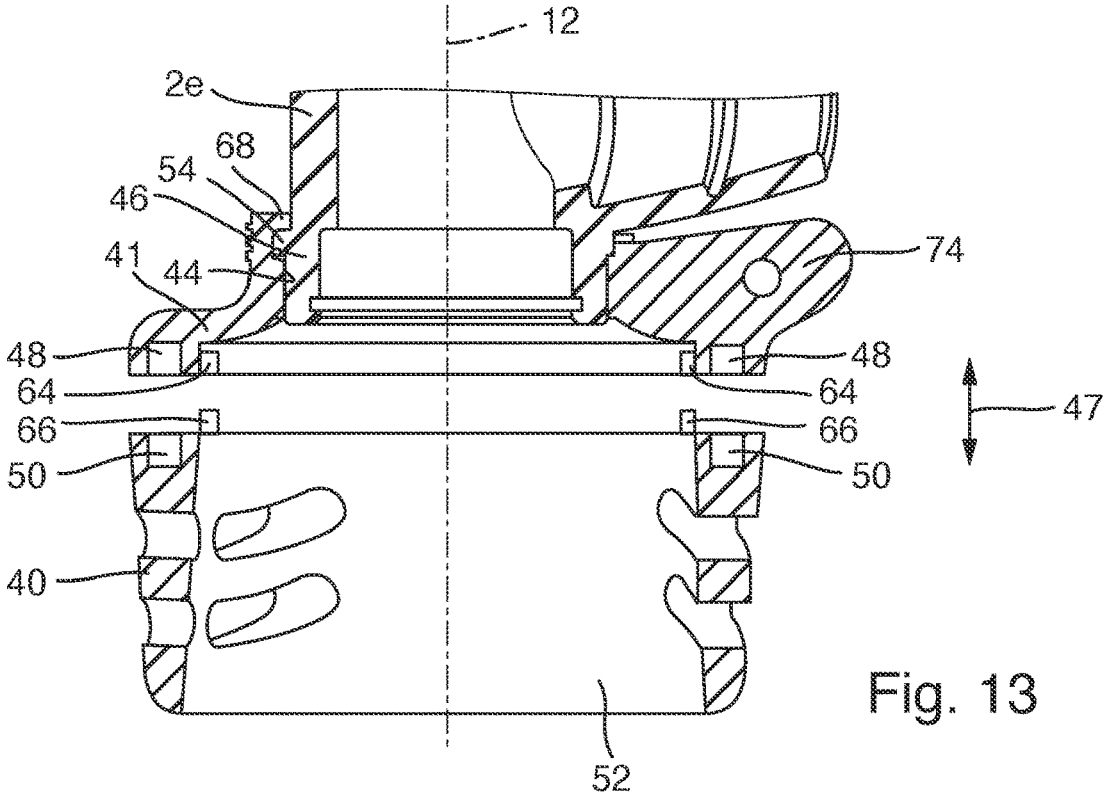
FIG. 13 an adapter element and a protective shroud according to the embodiment of FIG. 12 in a side view.
Figure 14:
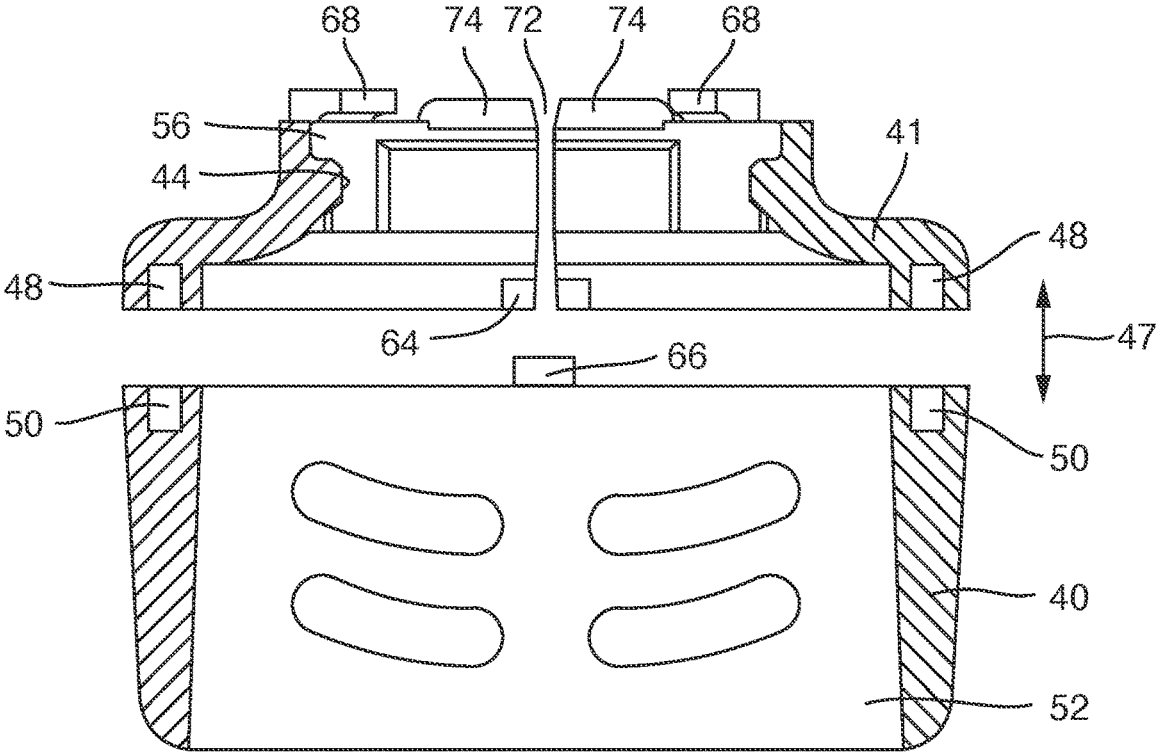
FIG. 14 an adapter element and a protective shroud according to the embodiment of FIG. 12 in a view rotated by 90° in respect to FIG. 13.

The first attachment member 29 may be in the form of a hexagonal recess. It is adapted to releasably attach the base element 28 of the functional unit 27 to the tool shaft 23 of the power tool 1 by means of mechanical force (e.g. by means of a threaded connection) and/or magnetic force (see FIG. 12 with magnetic elements, preferably in the form of one or more permanent magnets 86, provided in a top surface of the functional unit 27, in particular below or in the bottom of the hexagonal recess 29, interacting with a ferromagnetic hexagonal distal element 23*a* of the tool shaft 23). In FIGS. 1 and 2 the functional unit 27 and in particular the first attachment member 29 are shown only schematically.

The second attachment member 30 may comprise a protruding hexagonal element. It is adapted to releasably attach the working element 11 to the base element 28 of the functional unit 27 by means of mechanical force (e.g. by means of a threaded connection) and/or magnetic force (see FIG. 12 with magnetic elements, preferably in the form of one or more permanent magnets 88, provided in a top surface region 11*b* of the working element 11, in particular below or in the bottom of the hexagonal recess 11*f* of the working element 11, interacting with the ferromagnetic hexagonal distal element 30 of the functional unit 27).

Depending on the type of functional unit 27 interposed between the tool shaft 23 and the working element 11, the working element 11 performs different types of working movements. For example, it may perform a purely rotational, an orbital or eccentric, a random-orbital or a roto-orbital (gear-driven) working movement. The functional units 27 may each comprise a base element 28 having the form of a simple extension element 28*a* (see FIG. 2), an eccentric element 28*b* (see FIGS. 7, 8 and 11) or a gear mechanism, in particular an epicyclic or planetary gear mechanism (not shown). An extension element 28*a* is attached to the tool shaft 23 and the working element 11 in a torque proof manner, in order to realize a purely rotational working movement of the working element 11 corresponding to the rotational movement of the tool shaft 23. An eccentric element 28*b* is attached to the tool shaft 23 in a torque proof manner. The working element 11 is supported in the eccentric element 28*b* in a freely rotatable manner. Rotational axes 12, 12' of the tool shaft 23 and the working element 11 extend essentially parallel and in a distance (the orbit or eccentric) to each other. The eccentric element 28*b* serves for realizing a random-orbital working movement. A gear mechanism serves for realizing a roto-orbital or gear-driven working movement.

The working element 11 is at least partially covered by a protective shroud 40, which—in the prior art—is mechanically fixed to the housing 2 of the power tool 1, in particular to a bottom end 46 of the front casing 2*e*. The protective shroud 40 may serve a variety of purposes. First of all, it may serve to protect a user of the power tool 1 from moving parts of the power tool 1 protruding from the housing 2. These moving parts may comprise part of the tool shaft 23, at least part of the functional unit 27 and/or a part of the working element 11 facing towards the housing 2, e.g. a top surface 11*b* of a backing pad 11*a*. Further, the protective shroud 40 may serve as a dust collecting member for collecting at least part of the dust and small particles created during intended use of the power tool 1. To this end, an inside cavity 52 of the protective shroud 40 may be attached to an internal dust extraction device of the power tool 1 and/or an external dust extraction device, e.g. a vacuum cleaner (not shown). Furthermore, the protective shroud 40 may serve as a braking member, for slowing down, impeding or even completely preventing a rotation of the working element 11 about its rotational axis 12', when supported by an eccentric element 28*b* in a freely rotatable manner. In this way, the random-orbital movement of the working element 11 may be turned into an orbital or eccentric working movement.

The protective shroud 40 is preferably made of plastic material, in particular a soft plastic or synthetic rubber material. However, it could also be made of any other material, e.g. a hard plastic material. In the prior art the protective shroud 40 is attached to the housing 2 of the power tool 1 by means of a mechanical connection, e.g. by means of at least one screw, rivet, a snap-on connection, a clamping connection or the like. In contrast thereto, the present invention suggests that the protective shroud 40 is directly or indirectly secured to the housing 2 in at least one direction by means of magnetic force. The shroud 40 according to the invention can be attached to the housing 2 of the power tool 1 and detached therefrom fast and easy. Still, the shroud 40 is attached to the housing 2 in a safe and reliable manner.

The present invention is described in connection with a special small-sized power tool 1 with an interchangeable functional unit 27, like the one shown in FIGS. 1 and 2. However, the invention may also be realized with any other kind of power tool 1 having a moving working element 11 and a protection shroud 40 covering at least part of the working element 11. For example, the invention could be realized with a conventional polishing machine of the type LHR 15 II or with a conventional sanding machine of the type ER 153 TES offered for sale by RUPES S.p.A. or with a grinding machine, a power drill, or the like.

Figure 3:
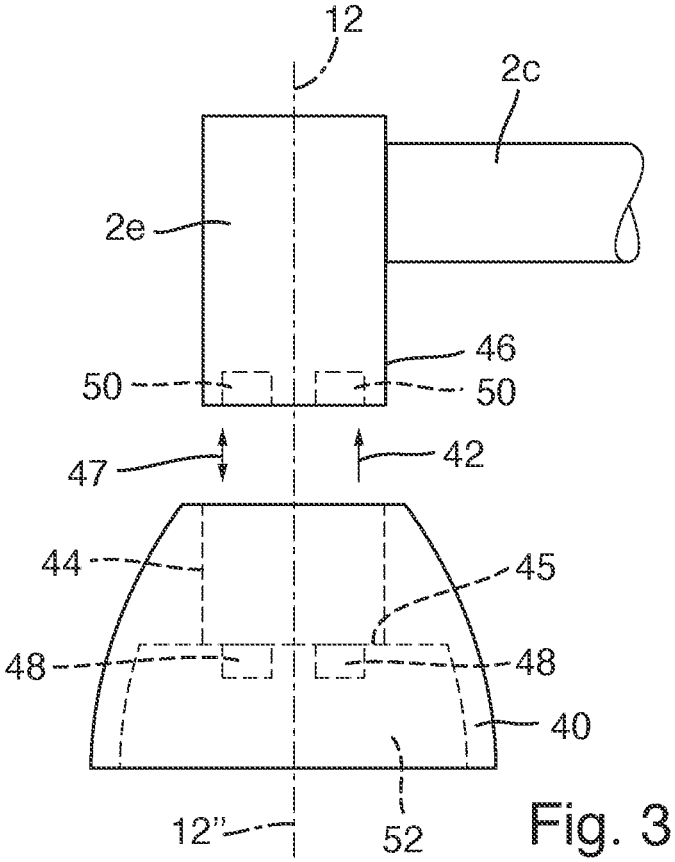
FIG. 3 an example of a front part of the power tool of FIGS. 1 and 2 with a protective shroud in a first embodiment in a schematic side view.
Figure 4:
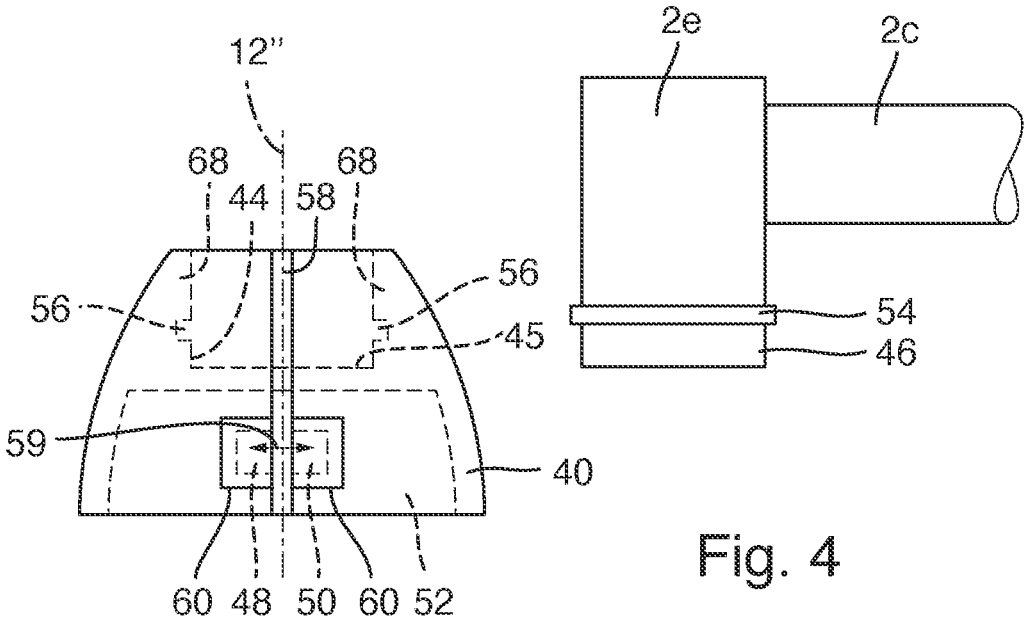
FIG. 4 an example of a front part of the power tool of FIGS. 1 and 2 with a protective shroud in a second embodiment in a schematic side view.
Figure 5:
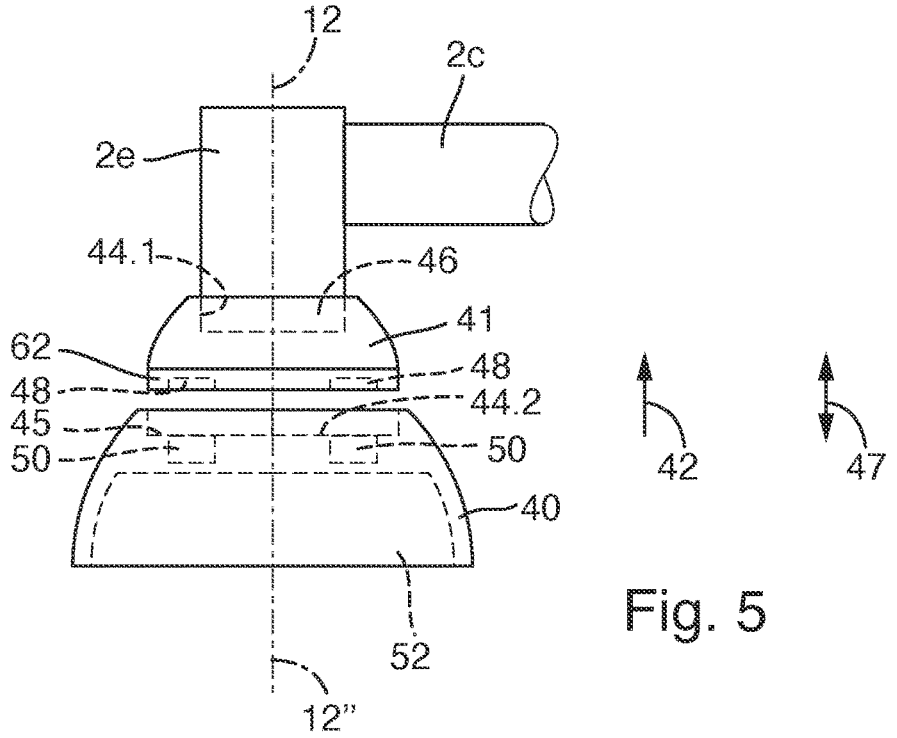
FIG. 5 an example of a front part of the power tool of FIGS. 1 and 2 with a protective shroud in a third embodiment in a schematic side view.
Figure 6:
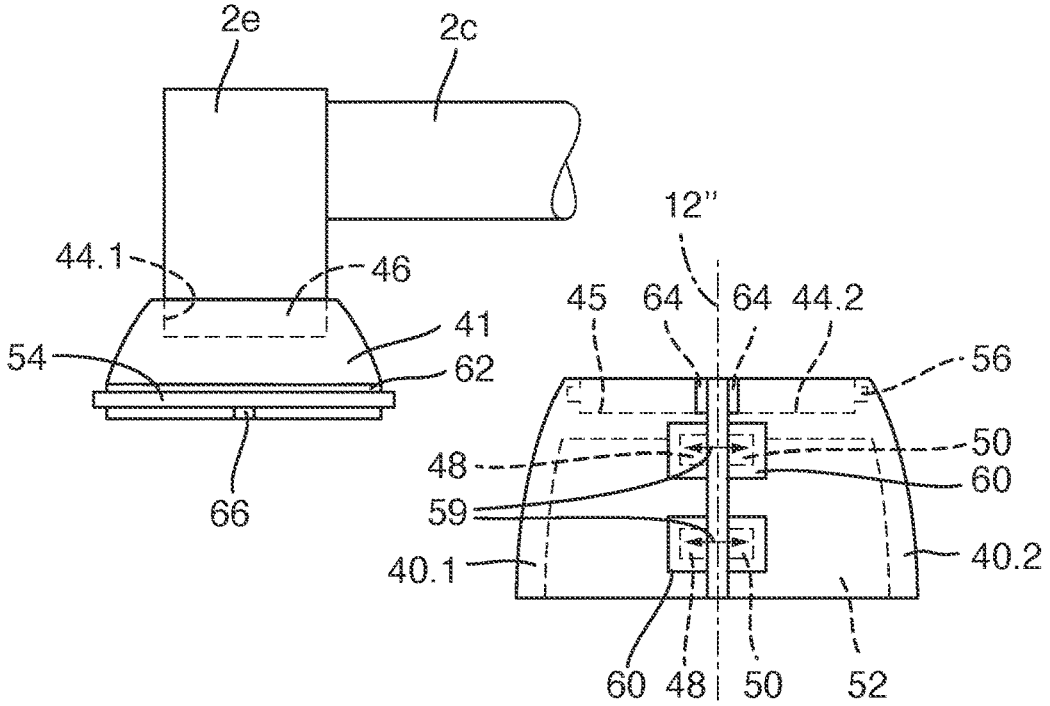
FIG. 6 an example of a front part of the power tool of FIGS. 1 and 2 with a protective shroud in a fourth embodiment in a schematic side view.

FIGS. 3 to 6 show different preferred embodiments of the present invention each in a schematic view. In the embodiments of FIGS. 3 and 4 the protective shroud 40 is directly attached to the housing 2 of the power tool 1, in particular to the bottom end 46 of the front casing 2*e*. In the embodiments of FIGS. 5 and 6 the protective shroud 40 is indirectly attached to the housing 2 by means of an adapter element 41 which is fixed to the housing 2, in particular the bottom end 46 of the front casing 2*e*. The adapter element 41 may be fixed to the housing 2 mechanically (e.g. by means of screws, friction, clip-on-members, snap-on-members, etc.) and/or magnetically (e.g. by means of magnetic elements, in particular permanent magnets and/or ferromagnetic elements). The protective shroud 40 is attached and magnetically secured to the adapter element 41. In the embodiments of FIGS. 3 and 5 the magnetic force 47 acts in an axial direction, i.e. parallel to a longitudinal axis 12" of the protective shroud 40 and to the rotational axis 12 of the tool shaft 23 and to an insertion direction 42 in which the shroud 40 is attached to the bottom end 46 of the front casing 2*e* of the housing 2 or the bottom end 62 of the adapter element 41 fixed to the housing 2. In the embodiments of FIGS. 4 and 6 the magnetic force 59 acts in a tangential direction, i.e. at the outer circumference of the protective shroud 40 tangentially in respect to the longitudinal axis 12" of the protective shroud 40 and to the rotational axis 12 of the tool shaft 23. Of course, the tangential magnetic force 59 could also act at the inner circumference of the protective shroud 40. The insertion direction 42 shows the direction in which the protective shroud 40 is attached to the housing 2.

In FIG. 3, the protective shroud 40 has an essentially tube-like form, possibly with a varying outer diameter. In particular, the outer diameter increases starting from that end, with which the shroud 40 is attached to the housing 2, towards the opposite end facing the working element 11. The inside of the shroud 40 comprises a receptacle 44 for receiving the bottom end 46. The bottom end 46 of the front casing 2*e* can be inserted into the receptacle 44 in a direction opposite to the insertion direction 42. Preferably, both the bottom end 46 and the receptacle 44 have a circular cross section. Hence, the protective shroud 40 may be attached to the front casing 2*e* of the housing 2 in any desired rotational position about the longitudinal axis 12". Of course, the protective shroud 40 could also be attached to the front casing 2*e* of the housing 2 in only one rotational position about the longitudinal axis 12". The bottom end 46 of the front casing 2*e* forms a cylindrical insertion element and the receptacle 44 forms a hollow cylinder. The receptacle 44 has an internal cross section corresponding to the external cross section of the bottom end 46 of the front casing 2*e*. Preferably, the receptacle 44 and the bottom end 46 have the rotational axis 12 of the tool shaft 23 of the power tool 1 as their cylinder axes, when the protective shroud 40 is attached to the housing 2. The protective shroud 40 is attached to the housing 2 when the bottom end 46 of the front casing 2*e* is inserted in the receptacle 44 of the shroud 40.

An abutment member 45 comprising at least one circumferential collar member is provided on an internal wall of the receptacle 44. The abutment member 45 extends radially inwards towards the longitudinal axis 12" of the protective shroud 40. When inserting the bottom end 46 of the front casing 2*e* of the housing 2 into the receptacle, the bottom end 46 may abut against the abutment member 45. Hence, the protective shroud 40 is attached to the housing 2 in a defined plane extending parallel to the extension of the abutment member 45, i.e. essentially perpendicular to the insertion direction 42 and to the rotational axis 12 of the tool shaft 23 and to the longitudinal axis 12" of the shroud 40. Hence, the shroud 40 is mechanically attached to the housing 2 in the two-dimensional plane.

The protective shroud 40 is secured to the housing 2 in an axial direction by means of magnetic force 47. To this end, magnetic elements and/or ferromagnetic elements are provided in the shroud 40 (elements 48) and the housing 2 (elements 50). The shroud 40 and the housing 2 can both be provided with magnetic elements 48, 50 or one of them with magnetic elements 48 and the other one of them with ferromagnetic elements 50. If one of the two is made of ferromagnetic material, e.g. if the housing 2 is made of iron or steel, there would be no need for additional ferromagnetic elements 50 but the housing 2 itself could be used as ferromagnetic element instead. In FIG. 3 the magnetic force 47 acts in an axial direction, that is parallel to the rotational axis 12 of the tool shaft 23 and to the longitudinal axis 12" of the shroud 40 and to the insertion direction 42. Hence, the interaction between the bottom end 46 of the housing 2 and the receptacle 44 of the shroud 40 attaches the shroud 40 to the housing 2 in a mechanically defined plane. The shroud 40 is secured to the housing 2 in a direction perpendicular in respect to the plane, by means of magnetic force 47. A bottom end of the shroud 40 comprises an internal cavity 52 in which a moving part of the power tool 1 extending beyond the housing 2, e.g. part of the tool shaft 23, part of the functional unit 27, the base element 28 or a top surface region 11*b* of the working element 11, may be located during intended use of the power tool 1.

In the embodiment of FIG. 4, the bottom end 46 of the front casing 2*e* of the housing 2 comprises a protrusion 54 in the form of a circumferential collar extending radially outwards away from the longitudinal axis 12" of the shroud 40. The collar 54 may extend along the entire circumference of the bottom end 46 or only along part of the circumference. The receptacle 44 in the protective shroud 40 comprises a corresponding recess 56 in the form of a circumferential groove, which is adapted to receive the collar 54 when the bottom end 46 is inserted into the receptacle 44. Hence, in FIG. 4 the position of the protective shroud 40 in respect to the housing 2 in the two-dimensional plane is defined by the protrusion 54 interacting with the respective recess 56.

In order to allow insertion of the bottom end 46 of the front casing 2*e* into the receptacle 44, the protective shroud 40 comprises a lateral slit 58 extending parallel to the longitudinal axis 12" of the shroud 40 and to the rotational axis 12 of the tool shaft 23. The shroud 40 is preferably made of a plastic material, in particular a resilient and/or elastic material, and can be bent open along the slit 58 thereby increasing the diameter of an upper insertion opening into the receptacle 44 of the shroud 40 and allowing the protrusion 54 to be inserted into the receptacle 44. If the bottom end 46 of the front casing 2*e* has been inserted far enough into the receptacle 44, the protrusion 54 can enter into the recess 56. Thereafter, the shroud 40 can be bent together again along the slit 58 thereby holding the protective shroud 40 in respect to the housing 2 of the power tool 1 in a plane extending parallel to the extension of the recess 56 and in a direction extending perpendicular in respect to the plane. Hence, the shroud 40 is mechanically attached to the housing 2 in a defined three-dimensional space.

In order to secure the protective shroud 40 to the housing 2, magnetic force 59 is used. To this end, it is suggested that the magnetic force 59 acts in a tangential direction in the region of the slit 58. The magnetic force 59 urges the slit 58 and the shroud 40, respectively, in a closed position, thereby avoiding an unintentional opening of the shroud 40 along the slit 58 and detachment of the shroud 40 from the housing 2. To this end it is suggested that the shroud 40 comprises magnetic elements 48, 50 one on each side wall limiting the slit 58 on opposite sides of the slit 58 and facing each other. Alternatively, one or more magnetic elements 48 can be provided on one side of the slit 58 and one or more ferromagnetic elements 50 can be provided on the other side of the slit 58. The magnetic or ferromagnetic elements 48, 50 can be located inside the side wall of the shroud 40, in particular of the chamber 52, or in external protrusions 60 provided externally on the side wall of the shroud 40, in particular of the chamber 52. Preferably, the protrusions 60 form an integral part with the side wall of the shroud 40 and are designed therewith in a single part.

The embodiment of FIG. 5 is similar to that of FIG. 3. One difference is that the protective shroud 40 is not attached directly to the housing 2 but rather indirectly by means of an adapter element 41, which is fixed to the housing 2. The advantage of this embodiment is that a conventional tool housing 2 could be extended by the functionality of magnetically securing a protective shroud 40 to the housing 2 without having to modify the housing 2 itself. This is achieved by the adapter element 41 being fixed to the bottom end 40 of the front casing 2*e*. The adapter element 41 is preferably mechanically attached and secured to the bottom end 46, e.g. by means of one or more screws, rivets, a clamping connection, a snap-on connection, gluing, welding or the like. To this end, the adapter element 41 comprises a first receptacle 44.1 for receiving the bottom end 46 of the front casing 2*e* and the mechanical connection acts between the receptacle 44.1 of the adapter element 41 and the bottom end 46 of the housing 2. However, the adapter element 41 could also form an integral part of and a single element with the front casing 2*e* of the housing 2.

The protective shroud 40 may be attached to the adapter element 41 and secured thereto by magnetic force 47. To this end, the adapter element 41 may comprise an insertion section 62 and the shroud 40 comprises a second receptacle 44.2 adapted for receiving the insertion section 62. The insertion section 62 can be inserted into the receptacle 44.2 in a direction opposite to the insertion direction 42. Preferably, both the insertion section 62 and the receptacle 44.2 have a circular cross section. Hence, the protective shroud 40 may be attached to the adapter element 41 and, hence, indirectly to the front casing 2*e* of the housing 2 in any desired rotational position about the longitudinal axis 12". Preferably, the protective shroud 40 is adapted to be attached to the adapter element 41 in only one rotational position. The adapter element 41 and the shroud 40 are preferably made of the same material. The material may be, for example, a hard plastic material, a soft plastic material and/or natural or synthetic rubber.

The insertion section 62 of the adapter element 41 forms a cylindrical insertion element and the second receptacle 44.2 of the shroud 40 forms a hollow cylinder. The receptacle 44.2 has an internal cross section corresponding to the external cross section of the insertion section 62. Preferably, the cylindrical receptacle 44.2 and the cylindrical insertion section 62 have the rotational axis 12 of the tool shaft 23 of the power tool 1 as well as the longitudinal axis 12" of the shroud 40 as their cylinder axes. A bottom surface or collar 45 of the second receptacle 44.2 may serve as an abutment member for the adapter element 41 when inserted into the receptacle 44.2. When the insertion section 62 is inserted in the receptacle 44.2, the protective shroud 40 is mechanically attached to the housing 2 in a defined two-dimensional plane extending essentially perpendicular to the insertion direction 42 and to the rotational axis 12 of the tool shaft 23 and to the longitudinal axis 12" of the shroud 40.

The protective shroud 40 is secured to the adapter element 41 in an axial direction by means of magnetic force 47. To this end, magnetic elements 48 and/or ferromagnetic elements 50 are provided in the adapter element 41 and the shroud 40. The adapter element 41 and the shroud 40 can both be provided with magnetic elements 48, 50 or one of them with magnetic elements 48 and the other one of them with ferromagnetic elements 50. If one of the two is made of ferromagnetic material, e.g. if the adapter element 41 is made of iron or steel, there would be no need for separate ferromagnetic elements 48 but the adapter element 41 itself could be used as ferromagnetic element instead. In FIG. 5 the mechanical interaction between the insertion section 62 of the adapter element 41 and the receptacle 44.2 of the shroud 40 attaches the shroud 40 indirectly to the housing 2 in a defined plane. In a direction perpendicular in respect to the plane, i.e. parallel to the insertion direction 42 and the longitudinal axis 12" the shroud 40 is secured to the adapter element 41 and, hence, indirectly to the housing 2 by means of the magnetic force 47.

The embodiment of FIG. 6 is similar to the embodiment of FIG. 4. One difference is that in FIG. 6 the protective shroud 40 is not directly attached to the housing 2 but rather indirectly by means of an adapter element 41, similar to what has been described above in respect to FIG. 5. Further, the shroud 40 is not made of a single part but comprises a plurality of parts. In particular, the shroud 40 comprises two separate half-shell-like elements 40.1, 40.2 which when connected to each other constitute the protective shroud 40. The two elements 40.1, 40.2 may be separated from each other in a vertical plane 98 comprising or extending parallel to the longitudinal axis 12" of the protective shroud 40 and the rotational axis 12 of the tool shaft 23. The two half-shell-like elements 40.1, 40.2 can be connected and held in respect to each other by magnetic force 59. When the two elements 40.1, 40.2 are connected to each other, they form a second receptacle 44.2 which is adapted to receive the insertion section 62 of the adapter element 41. The shroud 40 is attached to the adapter element 41 by approximating the two half-shell-like elements 40.1, 40.2 laterally from opposing sides in a radial direction such that the insertion section 62 is encompassed by the sections of the elements 40.1, 40.2 constituting the second receptacle 44.2, and the protrusion or collar 54 is inserted in the recess or annular groove 56. Similarly, the two separate elements 40.1, 40.2 could also be connected to each other by means of one or more hinge elements or snap-on elements or the like.

When the two half-shell-like elements 40.1, 40.2 are close together, the magnetic force 59 enters into action and attracts the two elements 40.1, 40.2 thereby securing the shroud 40 to the adapter element 41 and, hence, indirectly to the housing 2. The elements 40.1, 40.2 comprise lateral protrusions 60 holding or containing the magnetic elements 48 and/or the ferromagnetic elements 50. The protrusions 60 are provided on opposing sides of the vertical plane 98 separating the two elements 40.1, 40.2. The magnetic force 59 acts in a tangential direction, similar to what was previously described in respect to FIG. 4.

The two half-shell-like elements 40.1, 40.2 may comprise one or more notches 64 adapted for receiving one or more corresponding protrusions 66 provided on the insertion section 62 of the adapter element 41 or the front casing **2*e* of the housing 2. One notch 64 for receiving one protrusion 66 allows attachment of the half-shell-like elements 40.1, 40.2 or of the protective shroud 40, respectively, in only one discrete rotational position about the longitudinal axis 12" of the shroud 40 and the rotational axis 12 of the tool shaft 23. Of course, if the adapter element 41 or the front casing 2*e* of the housing 2, respectively, and the shroud 40 comprise more than one notch 64 and/or protrusion 66, respectively, distributed along the circumference of the insertion section 62 and the second receptacle 44.2, respectively, the shroud 40 could be attached in more than one discrete rotational position about the rotational axis 12 or the longitudinal axis 12"**.

Figure 15:
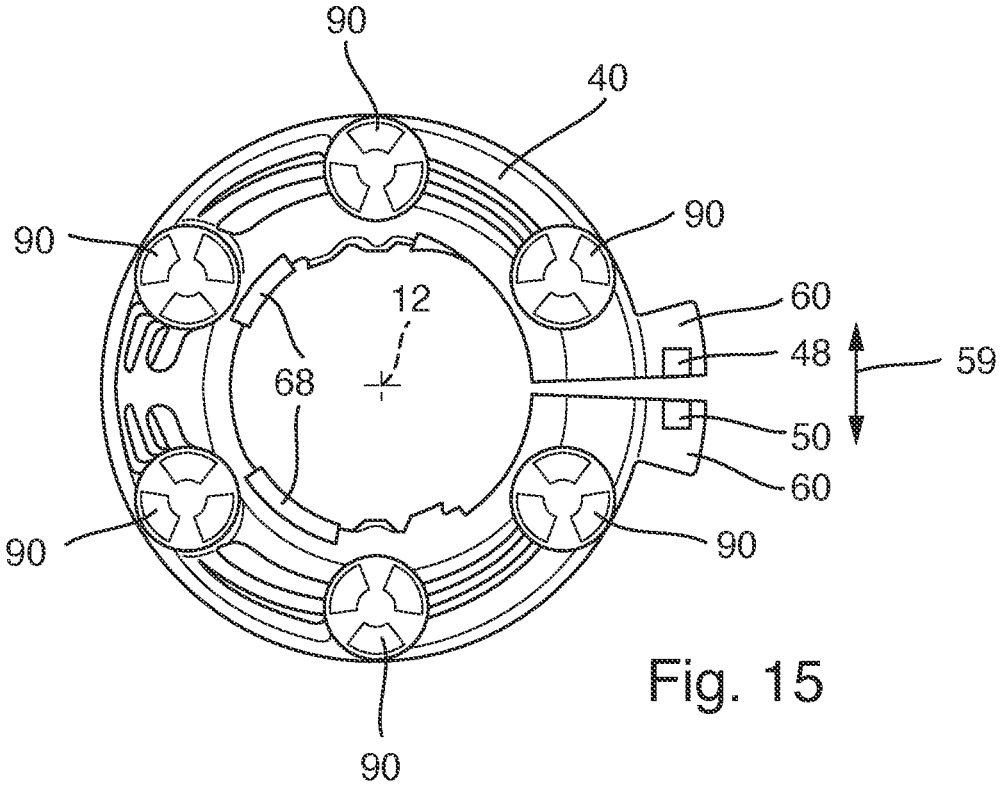
FIG. 15 another example of a protective shroud according to the invention in a bottom view.
Figure 16:
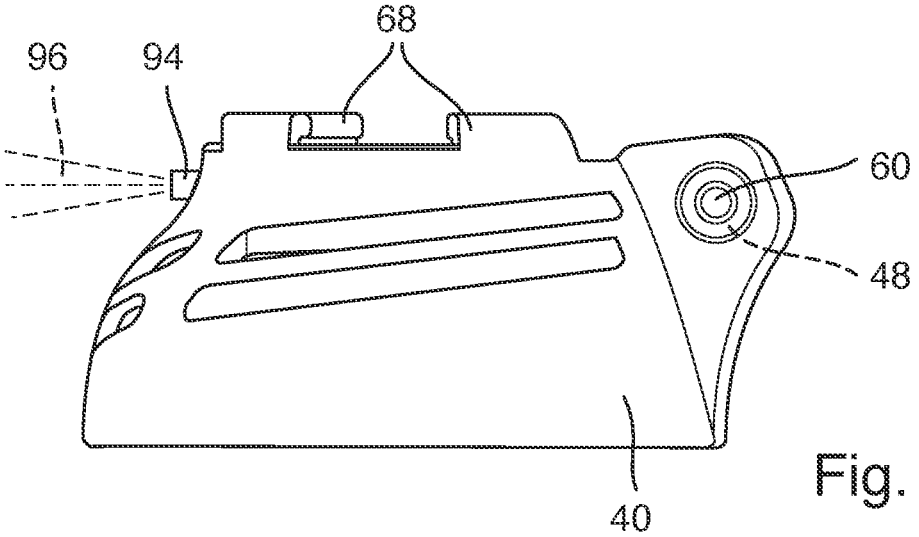
FIG. 16 the protective shroud of FIG. 15 in a side view.

Mounting of the shroud 40 in one or more discrete rotational positions in respect to the housing 2 is preferably realized if the rotational mounting position of the shroud 40 about the rotational axis 12 or the longitudinal axis 12" is important for further functionalities of the power tool or the shroud 40, respectively. This may be the case, for example, when the shroud 40 carries permanent magnets (see FIG. 15 with permanent magnets 90) and/or ferromagnetic elements interacting with respective magnetic elements (see FIG. 11 with permanent magnets 92) provided in a top surface **11*b* of the working element 11 for slowing down or even preventing a free rotation of the working element 11 about its rotational axis 12' and for realizing the functionality of transforming a random-orbital working movement of the working element 11 into an orbital working movement. Realization of an orbital working movement by means of magnetic force is described in detail in EP 3 501 732 A1, which is incorporated herein in its entirety by reference. One or more discrete rotational mounting positions of the shroud 40 in respect to the housing 2 may also be important, for example, if the shroud 40 carries light sources 94 (see FIG. 16) for emitting visible light 96** and for realizing the functionality of illuminating the working surface in a certain direction, in particular in front of the power tool.

The protrusions 66 could have a longitudinal extension in an axial and/or radial and/or circumferential direction. The notches 64 will preferably have a corresponding form and extension, in order to permit attachment of the shroud 40 to the adapter element 41 in one or more discrete rotational positions.

Of course, the one or more notches 64 could just as well be provided at the adapter element 41 or the front casing **2*e* of the housing 2, respectively, and, consequently, the one or more protrusions 66 would be provided at the protective shroud 40**.

Hence, in the embodiment of FIG. 6, the shroud 40 is held in respect to the adapter element 41 and to the housing 2 of the power tool 1, respectively, in a plane extending perpendicular in respect to the longitudinal axis 12" of the shroud 40 and in a direction extending parallel to the longitudinal axis 12". Hence, the shroud 40 is mechanically held at the housing 2 (indirectly by means of the adapter element 41) in the three-dimensional space. The shroud 40 is secured to the adapter element 41 and, hence, indirectly to the housing 2, by means of the magnetic force 59.

In all embodiments of FIGS. 3 to 6, the shroud 40 is held mechanically at the housing 2 or the adapter element 41 and secured thereto by means of magnetic force 47, 59. Only if the magnetic force 47, 59 is overcome, can the attachment of the shroud 40 to the housing 2 be released and the shroud 40 removed. Of course, in the realm of the present invention it would also be possible that the shroud 40 is attached magnetically (by means of magnetic force) to the housing 2 or the adapter element 41 and secured thereto by means of magnetic force 47, 59. In that case, the magnetic force for holding the shroud 40 at the housing 2 or the adapter element 41 can be identical to or different from the magnetic force 47, 59 for securing the shroud 40 to the housing 2 or the adapter element 41. Preferably, magnetic forces created by different magnetic elements are used for attachment of the shroud 40 to the housing 2 on the one hand and securing the shroud 40 to the housing 2 on the other hand.

Figure 7:
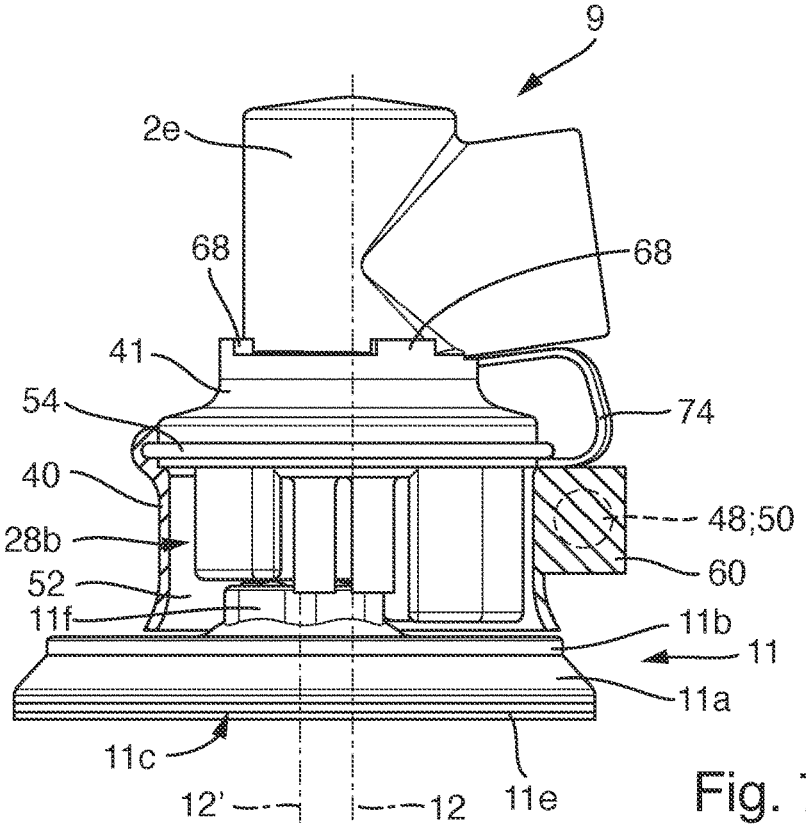
FIG. 7 a realization similar to the embodiment of FIG. 6, with the protective shroud mounted, partially in a sectional side view.
Figure 8:
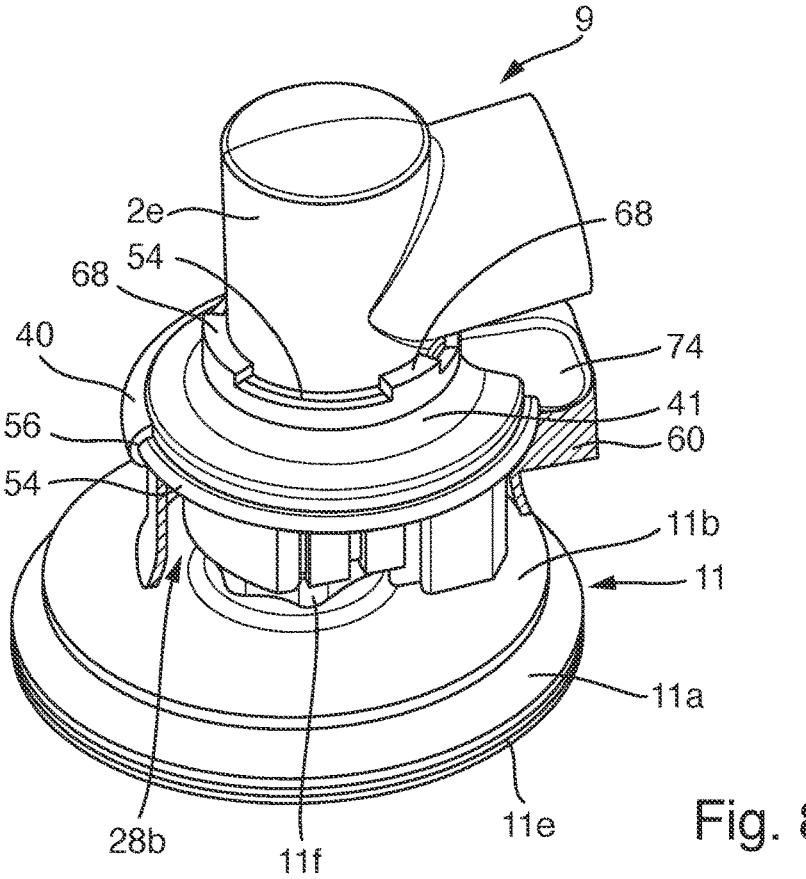
FIG. 8 the realization of FIG. 7 partially in a sectional perspective view.

FIGS. 7 and 8 show the tool head 9 of the power tool 1 with an embodiment similar to the one shown in FIG. 6. The protective shroud 40 is shown in a sectional view to allow insight into the internal chamber 52 inside the shroud 40. In particular, it can be seen that the base element 28 of the functional unit 27 comprising an eccentric element 28*b* as well as a protruding part 11*f* of the supporting structure 11*b* of the working element 11 comprising a backing pad 11*a* is at least partially located inside the chamber 52. In this embodiment the protruding part 11*f* of the working element 11 comprises a hexagonally shaped recess 11*g* for attachment to a correspondingly formed second attachment member 30 of the functional unit 27. Of course, the protruding part 11*f* of the working element 11 and the attachment member 30 of the functional unit 27 could have a different form, too.

In FIGS. 7 and 8 the adapter element 41 is mechanically attached to the bottom end 46 of the front casing 2*e* of the housing 2. In particular, the adapter element 41 is held by means of protruding elements 68. The protruding elements 68 are located in the opening of the first receptacle 44.1 of the adapter element 41 and protrude radially inwards and encompass a collar 70 circumferentially surrounding the front casing 2*e*. The adapter element 41 may comprise a slit 72 (see FIGS. 9, 10, 13 and 14) with two external protrusions 74 at both sides of the slit 72. The protrusions 74 may be mechanically clamped together in a circumferential direction by means of a screw (not shown). Alternatively, according to the embodiment of FIG. 10, the two protrusions 74 could comprise magnetic elements 76 and/or ferromagnetic elements 78 which are attracted by means of magnetic force 80. In that case, the protrusions 74 are magnetically clamped together by means of the magnetic force 80.

Figure 9:
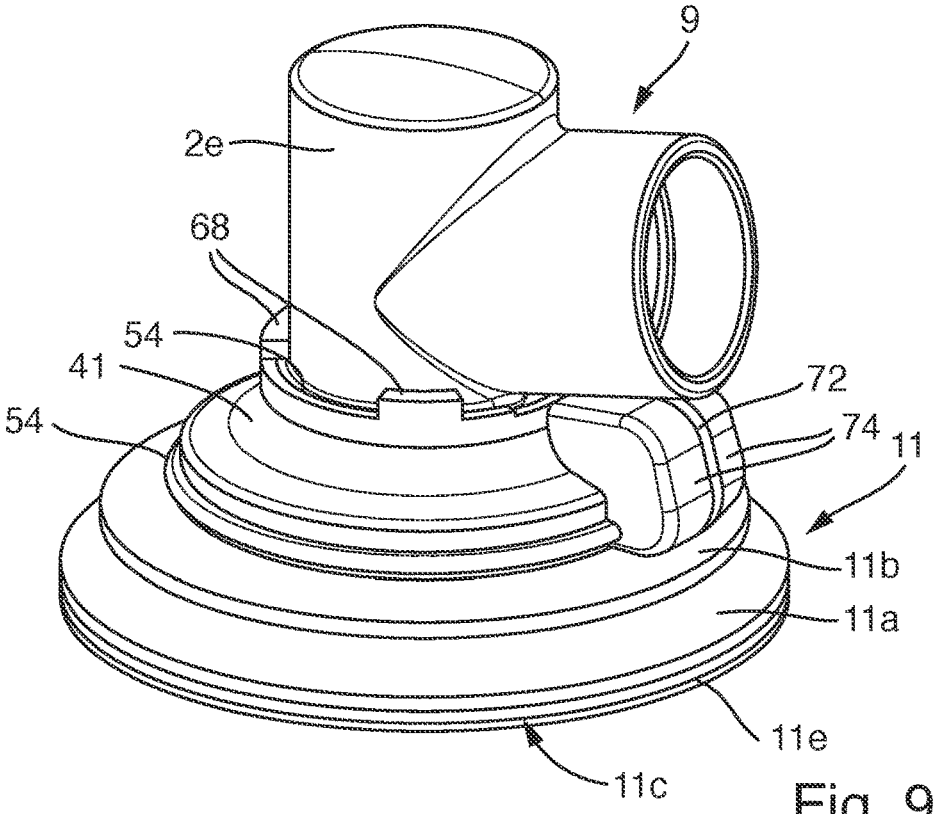
FIG. 9 a realization similar to the embodiment of FIG. 4, with the protective shroud mounted, partially in a perspective view.
Figure 10:
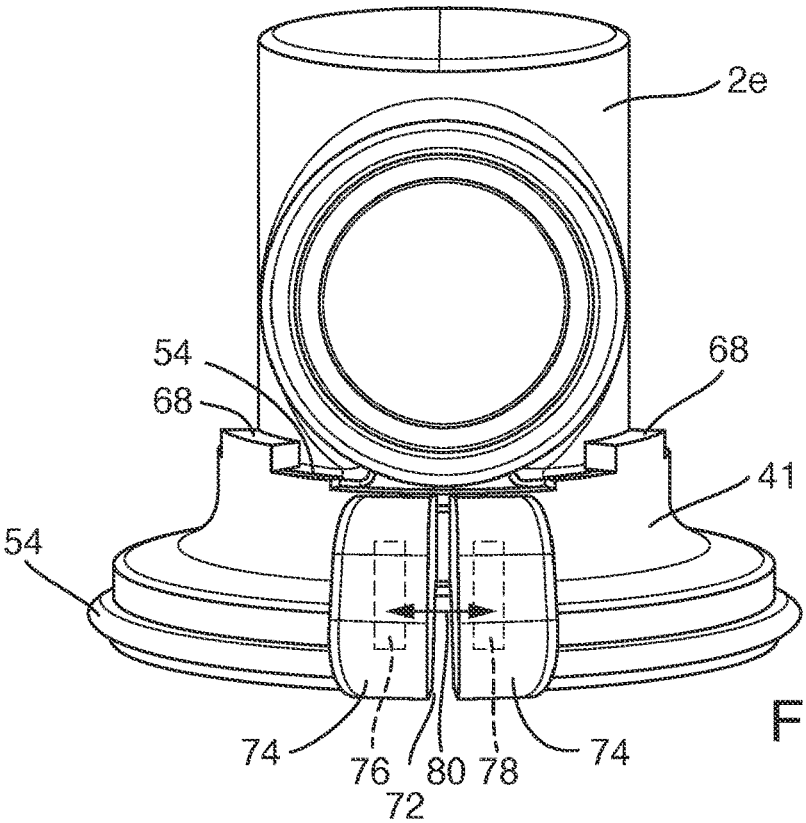
FIG. 10 the realization of FIG. 9 in a side view without a working element.

In the embodiment of FIGS. 9 and 10, the functional unit 27 has been omitted and the working element 11 is directly attached to the tool shaft 23. In that case, the working element 11 performs a purely rotational working movement. The protective shroud 40 or part of it is not needed and, therefore, may also be omitted. The adapter element 41 may fulfil the functions of the shroud 40. The chamber provided in the inside of the adapter element 41 contains only the protruding part 11*f* of the supporting structure 11*b* of the working element 11 or part of it. To this end, the protruding part 11*f* comprises a recess 11*g* having an internal hexagonal shape corresponding to the external hexagonal shape of a distal end 23*a* of the tool shaft 23. The hexagonally shaped distal end 23*a* of the tool shaft 23 may be an integral part thereof or a separate element attached to the distal end of the tool shaft 23. Without the functional unit 27, the overall power tool builds lower, has a lower profile and a lower centre of gravity closer to the tool housing 2. This leads to a higher stability and better performance of the power tool during its rotational working movement.

Figure 11:
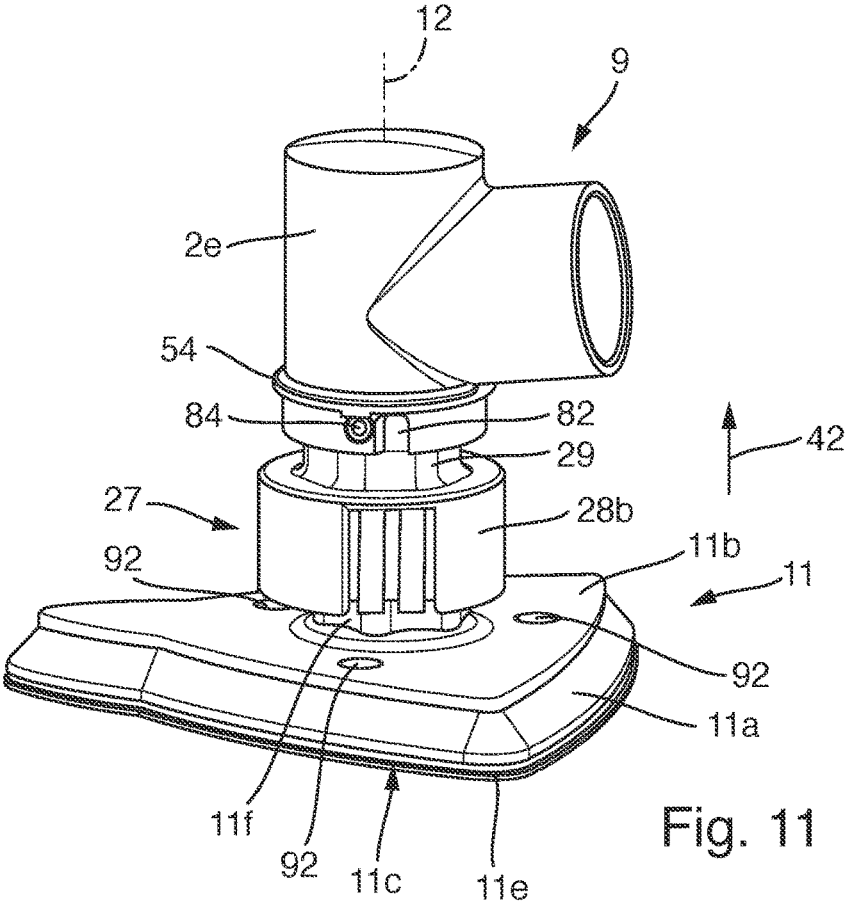
FIG. 11 a front part of the power tool of FIGS. 1 and 2 adapted for attachment of a protective shroud.

Finally, in the embodiment of FIG. 11, the working element 11 comprises a triangular or delta-shaped backing pad 11*a*. The functional unit 27 with the base element 28 comprising an eccentric element 28*b* is mounted to the tool shaft 23. To this end, a top surface of the eccentric element 28*b* comprises an attachment member 29 in the form of a recess having an internal hexagonal shape corresponding to the external hexagonal shape of the distal end 23*a* of the tool shaft 23. Preferably, the hexagonal recess 29 of the eccentric element 28*b* is the same as the hexagonal recess 11*g* of the protruding part 11*f* of the supporting structure 11*b* of the working element 11. The protective shroud 40 is not shown in order to permit a better view onto the bottom end 46 of the front casing 2*e* of the housing 2.

It can be clearly seen that the bottom end 46 comprises one or more recesses 82, 84. A first recess 82 has a longitudinal extension running essentially parallel to the rotational axis 12 of the tool shaft 23. The shroud 40 or the adapter element 41 has a corresponding protrusion (not shown) which is inserted into the recess 82 upon attachment of the shroud 40 or the adapter element 41 to the housing 2. The first recess 82 permits (in cooperation with the corresponding protrusion of the shroud 40 or the adapter element 41) attachment of the shroud 40 or the adapter element 41 to the housing 2 only in a discrete rotational position.

Further, a second recess 84 is provided at the bottom end 46 of the front casing 2*e* of the housing 2. The second recess 84 has an essentially circular form. The shroud 40 or the adapter element 41 has a corresponding protrusion (not shown) which is inserted into the recess 84 upon attachment of the shroud 40 or the adapter element 41 to the housing 2. The protrusion and the circular recess 84 form part of a snap-on connection which may serve for holding the protective shroud 40 or the adapter element 41 in the attached position on the housing 2. Additionally, the shroud 40 may be secured in respect to the housing 2 either directly or indirectly (by means of the adapter element 41) in at least one direction by means of magnetic force 47, 59.

The invention claimed is:

1. A hand-guided power tool (1) comprising a tool housing (2) containing a motor (16), a working element (11) driven by the motor (16) and rotating about a rotational axis (12) during operation of the motor (16) and protruding at least partially from the tool housing (2), and a protective shroud (40) releasably attachable to the tool housing (2) and covering at least part of the working element (11), the protective shroud (40) having a tube form with a cavity (52) defined in its inside adapted for receiving at least part of a functional unit (27) of the hand-guided power tool (1), when the protective shroud (40) is attached to the tool housing (2) of the hand-guided power tool (1), the functional unit (27) being arranged between a tool shaft (23) and the working element (11) of the hand-guided powertool (1) and comprising an eccentric element (28*b*) adapted for making the working element (11) perform a random-orbital working movement, wherein the protective shroud (40) is attached to the tool housing (2) when the functional unit (27) is arranged between the tool shaft (23) and the working element (11) of the hand-guided power tool (1), wherein the protective shroud (40) is secured to the tool housing (2) in at least one direction by means of magnetic force (47, 59), and wherein the protective shroud (40) is detached from the tool housing (2) when the working element (11) is directly attached to the tool shaft (23) without the functional unit (27) in-between making the working element (11) perform a rotational movement about the rotational axis (12).

2. The hand-guided power tool (1) according to claim 1, wherein the protective shroud (40) is adapted to be directly attached to the tool housing (2) of the hand-guided power tool (1).

3. The hand-guided power tool (1) according to claim 2, wherein the magnetic force (47) acts in an axial direction parallel to the rotational axis (12).

4. The hand-guided power tool (1) according to claim 2, wherein the tube form has a longitudinal axis (12") extending there through and the magnetic force (59) acts in a tangential direction in respect to the longitudinal axis (12").

5. The hand-guided power tool (1)) according to claim 2, wherein the tube form has a receptacle (44) defined in its inside adapted for receiving at least part of the tool housing (2) of the hand-guided power tool (1) for releasable attachment of the protective shroud (40) thereto.

6. The hand-guided power tool (1) according to claim 1, wherein the protective shroud (40) is adapted to be indirectly attached to the tool housing (2) of the hand-guided power tool (1) by means of an adapter element (41) fixed to the tool housing (2).

7. The hand-guided power tool (1) according to claim 6, wherein the magnetic force (47) acts in an axial direction parallel to the rotational axis (12).

8. The hand-guided power tool (1) according to claim 6, wherein the tube form has a longitudinal axis (12") extending there through and the magnetic force (59) acts in a tangential direction in respect to the longitudinal axis (12").

9. The hand-guided power tool (1) according to claim 1, wherein the tube form of the protective shroud (40) has a longitudinal axis (12") extending there through and the magnetic force (47) acts in an axial direction parallel to the longitudinal axis (12").

10. The hand-guided power tool (1) according to claim 1, wherein the tube form of the protective shroud (40) has a longitudinal axis (12") extending there through and the magnetic force (59) acts in a tangential direction in respect to the longitudinal axis (12").

11. The hand-guided power tool (1) according to wherein the tube form of the protective shroud (40) has a receptacle (44) defined in its inside adapted for receiving at least part of the tool housing (2) of the hand-guided power tool (1).

12. The hand-guided power tool (1) according to claim 11, wherein the receptacle (44) is adapted to receive at least part of the tool housing (2) of the hand-guided power tool (1) in an axial direction parallel to the rotational axis (12).

13. The hand-guided power tool (1) according to claim 11, wherein the receptacle (44) is adapted to receive at least part of the tool housing (2) of the hand-guided power tool (1) in a radial direction perpendicular to the rotational axis (12).

14. The hand-guided power tool (1) according to claim 13, wherein the protective shroud (40) has at least one lateral slit (58) extending in an axial direction parallel to the rotational axis (12"), adapted for laterally opening the protective shroud (40) and laterally encompassing at least part of the tool housing (2) of the hand-guided power tool (1) in the radial direction perpendicular to the rotational axis (12).

15. The hand-guided power tool (1) according to claim 13, wherein the protective shroud (40) is made up of at least two separate shell elements separated from each other by a vertical plane (98) having the rotational axis (12), adapted for laterally encompassing at least part of the tool housing (2) of the hand-guided power tool (1) in the radial direction perpendicular to the rotational axis (12).

16. The hand-guided power tool (1) according to claim 15, wherein the protective shroud (40) is made up of exactly two half-shell elements (40.1, 40.2).

17. The hand-guided power tool (1) according to claim 11, wherein an opening of the receptacle (44) is arranged at an end of the protective shroud (40) and an opening of a cavity (52) is arranged at an opposite end of the protective shroud (40).

18. The hand-guided power tool (1) according to claim 1, wherein the protective shroud (40) has at least one protrusion or recess (56) adapted for interacting with a corresponding recess or protrusion (54) provided on the tool housing (2) of the hand-guided power tool (1) in order to prevent the protective shroud (40) attached to the tool housing (2) from unintentionally slipping off the tool housing (2).

19. The hand-guided power tool (1) according to claim 1, wherein the protective shroud (40) has at least one protrusion or recess (64) adapted for interacting with a corresponding recess (82; 84) or protrusion (66) provided on the tool housing (2) of the hand-guided power tool (1) in order to allow attachment of the protective shroud (40) to the tool housing (2) in only one or more discrete rotational positions about the rotational axis (12).

20. The hand-guided power tool (1) according to claim 1, wherein the hand-guided power tool (1) is a polisher or a sander, and the working element (11) comprises a backing pad (11*a*) coupled to a bottom surface (11*c*) of which is a polishing member (11*d*) or a sanding member (11*e*).

21. The hand-guided power tool (1) according to claim 20, wherein the polishing member (11*d*) or the sanding member (11*e*) is attached to the bottom surface (11*c*) of the backing pad (11*a*) by means of a hook-and-loop fastener.

* * * * *